US008833981B2

(12) United States Patent
Bailey

(10) Patent No.: US 8,833,981 B2
(45) Date of Patent: Sep. 16, 2014

(54) MULTIPLE-TIER OMNIDIRECTIONAL SOLID-STATE EMISSION SOURCE

(75) Inventor: Edward E. Bailey, Westhampton, NJ (US)

(73) Assignee: Illumination Machines, LLC, Mt. Laurel, NJ (US)

( * ) Notice: Subject to any disclaimer, the term of this patent is extended or adjusted under 35 U.S.C. 154(b) by 0 days.

(21) Appl. No.: 13/494,013

(22) Filed: Jun. 11, 2012

(65) Prior Publication Data

US 2013/0187528 A1 Jul. 25, 2013

Related U.S. Application Data

(63) Continuation-in-part of application No. 13/093,794, filed on Apr. 25, 2011, now Pat. No. 8,215,802.

(60) Provisional application No. 61/327,485, filed on Apr. 23, 2010.

(51) Int. Cl.

| | |
|---|---|
| ***F21V 13/04*** | (2006.01) |
| ***F21V 29/00*** | (2006.01) |
| ***F21K 99/00*** | (2010.01) |
| *F21Y 101/02* | (2006.01) |
| *F21V 7/00* | (2006.01) |
| *F21V 3/04* | (2006.01) |
| *F21W 121/00* | (2006.01) |

(52) U.S. Cl.

CPC ..... *F21V 13/04* (2013.01); *F21Y 2101/02* (2013.01); *F21V 29/2206* (2013.01); *F21K 9/135* (2013.01); *F21V 7/0091* (2013.01); *F21V 3/0436* (2013.01); *F21K 9/52* (2013.01); *F21V 3/0463* (2013.01); *F21V 3/0418* (2013.01); *F21W 2121/00* (2013.01)

USPC ..... 362/311.02; 362/332

(58) Field of Classification Search

USPC ..... 362/311.02, 332, 327, 254

See application file for complete search history.

(56) References Cited

U.S. PATENT DOCUMENTS

| | | | | |
|---|---|---|---|---|
| 7,524,098 | B2 * | 4/2009 | Vennetier et al. | 362/555 |
| 2004/0080948 | A1 * | 4/2004 | Subisak | 362/327 |
| 2007/0139932 | A1 * | 6/2007 | Sun et al. | 362/331 |
| 2010/0046218 | A1 * | 2/2010 | Huang | 362/235 |
| 2011/0228542 | A1 * | 9/2011 | Hsueh et al. | 362/327 |

* cited by examiner

*Primary Examiner* — Laura Tso

(74) *Attorney, Agent, or Firm* — White-Welker & Welker, LLC; Matthew T. Welker, Esq.

(57) ABSTRACT

Multiple-tier omnidirectional solid-state emission source capable of dispersing light in flexible distributions or custom-intensity distributions which throw more light forward, to the side alternatively, or in all directions. This optical light control requires multiple-surface manipulation of the directions of the light energy bundles emerging from solid-state light sources. Producing uniform light up to 325 degrees in the vertical direction through the combined implementation of multi-stage light guiding for remote source elongation and multiple-tiers of TIR, refraction, and scatter for remote source emission and control. Combining the efficient light production of an LED chip with that of a directly coupled optic results in high efficiency custom distribution to direct light where required. The optical light manipulator consists of a dielectric or reflector collector section, spline light-pipe section used to clear the cross-sectional area of a thermal dissipation device and a section which either externally, internally, or combinatorially feeds multiple-tier TIR/refractor elements.

16 Claims, 41 Drawing Sheets

US Energy Star v. 1.4
Critical specification for "Standard" A lamps
1) Uniformity: deviation from mean shall be <20% of mean intensity
2) Critical zone 135 - 180deg shall have >5% of total light

1

| | | |
|---|---|---|
| intensity 0 - 135deg zone statistics | | |
| MAX | 80.44 | |
| AVERAGE | 68.98 | |
| MIN | 57.35 | |
| Uniformity +20% upper bound | 82.78 | 102.9% |
| Uniformity -20% lower bound | 55.18 | 103.9% |

2 critical zone flux 135 - 180deg 9.90%

US Energy Star v. 1.4
Critical specification for "Standard" A lamps
1) Uniformity: deviation from mean shall be <20% of mean intensity
2) Critical zone 135 - 180deg shall have >5% of total light

1

| intensity 0 - 135deg zone statistics | | |
|---|---|---|
| MAX | 78.78 | |
| AVERAGE | 70.72 | |
| MIN | 67.06 | |
| Uniformity +20% upper bound | 84.86 | 107.7% |
| Uniformity -20% lower bound | 56.57 | 118.5% |

2 critical zone flux 135 - 180deg 9.09%

MULTIPLE-TIER OMNIDIRECTIONAL SOLID-STATE EMISSION SOURCE

CROSS REFERENCE TO RELATED APPLICATIONS

This application claims priority from and is a Continuation In Part of U.S. patent application Ser. No. 13/093,794, entitled "Multiple-tier Omnidirectional Solid-State Emission Source", filed on Aug. 11, 2007, which is incorporated by reference in its entirety for all purposes as if fully set forth herein.

U.S. patent application Ser. No. 13/093,794 claims priority from U.S. Provisional Patent Application Ser. No. 61/327,485, entitled "Multiple-tier Omnidirectional Solid-State Emission Source", filed on 23 Apr. 2010. The benefit under 35 USC §119e of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to LED's or light emitting diodes. More specifically, the present invention relates to a solid-state filament wherein the tungsten filament is replaced with an array of high efficiency LED emitters which combine through a lightguide injector and then disperse into a wider solid-angle distribution after passing through a multi-stage lightguide and control via multiple tiers of TIR/refractive elements.

BACKGROUND OF THE INVENTION

Over 650 Million omnidirectional 60 watt incandescent light bulbs were sold in the United States in 2008. Many light fixtures require omnidirectional light, i.e. light which emanates in all directions; upward, laterally, and downward to simultaneously illuminate work tasks, writing, and to decoratively illuminate a wall or ceiling architectural feature as required for interior design illumination. Incandescent and halogen lights are heater filaments which produce only 12-15 lumens/Watt. There is a need for high luminous efficacy solid-state lighting sources which can match the incandescent light source in appearance both in terms of color quality, and in distribution of the light.

Currently, 2009 90CRI warm white LED light is commercially available at 100 lumens/Watt, with advancements accelerating the availability of 150 lumen/Watt warm white light sources very soon at larger single chip sizes up to 25 mm^2 capable of producing greater than 4000 lumens. Previous generation solutions to the production of semi-omnidirectional LED light have failed to achieve the efficiency and lifetime required to solidify a strong buy position for those interested in energy-efficient lighting technology.

SUMMARY OF THE INVENTION

Omni-directional light produced by a tent filament incandescent B-10 or vertical filament A-19 lamp produces light in all directions or greater than 325 degrees full angle distribution in the vertical direction as well as 360 horizontally or in the azimuth direction. LED sources typically only produce light in a Lambertian beam pattern with maximum dispersion of 180 degrees full distribution. The present invention efficiently disperses light greater than 325 degrees, as required for standard decorative illumination.

The optics taught by the present invention are capable of dispersing light in flexible distributions or custom-intensity distributions which throw more light forward, to the side alternatively, or strongly in all directions. To achieve this degree of optical light control requires multiple-surface manipulation of the directions of the light energy bundles emerging from solid-state light sources. Producing uniform light up to 325 degrees in the vertical direction is possible through the combined implementation of multi-stage light guiding for remote source elongation and multiple-tiers of TIR, refraction, and scatter for remote source emission and control. The result of combining the efficient light production of an LED chip with that of a directly coupled optic is high efficiency custom distribution to direct light where required. The optical light manipulator consists of a dielectric or reflector collector section, spline light-pipe section used to clear the cross-sectional area of a thermal dissipation device and a section which either externally, internally or combinatorially feeds multiple-tier TIR/refractor elements.

In other configurations succeeding stages of light guiding feed internal multiple-tier dispersing element trees which direct the light outwardly to fill direction cosine zones uniformly. The combined effect is to throw light downward, to the sides, and upward uniformly to such a degree that the net effect results in a pleasing sparkle light effect which emulates the vertical filament incandescent.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings where like numbers represent like elements, which form a part hereof, and in which is shown by way of illustration specific exemplary embodiments disclosing how the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

Referring to the Figures, it is possible to see the various major elements constituting the apparatus of the present invention. The enclosed Figure drawings are intended to illustrate the principle of flexible light distribution control through the means of a system of multiple TIR/refractor elements fed light through a multi-stage lightguide. Although decorative omnidirectional light is enclosed as a primary application, other directional lighting products could also be produced in which a lateral emitting or butterfly distribution pattern emulates the light distribution of a ceramic metal halide T4 source for track or downlighting. The drawings enclosed in FIGS. 15-21 are only example geometric solutions and intermediates in the evolutionary design process are also acceptable. The geometric forms enclosed are not meant to form a limitation, but to illustrate design process genius by which other optics can be designed. Whether implemented with only 2 or 1000's of TIR and TIR/refractor elements, the design principle is similar. To control with finer precision to <1 degrees requires more and more elements which individually contribute to the uniform fill of light distribution.

Figure 1:
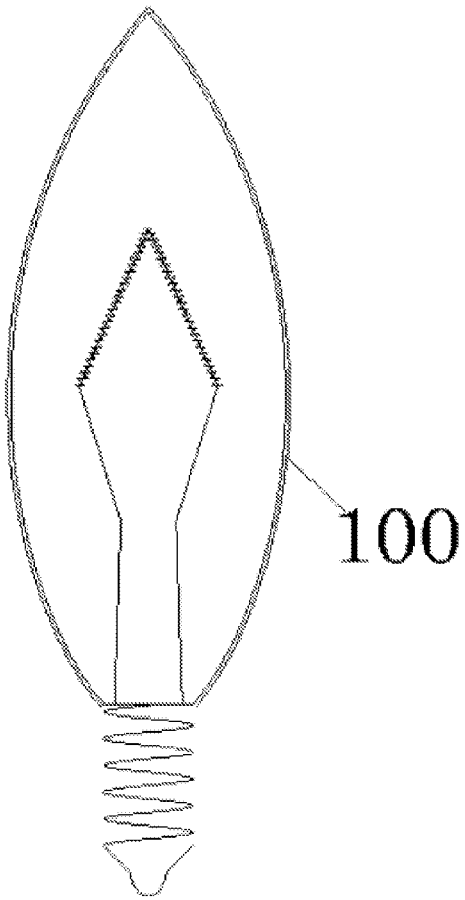
PRIOR ART Figure 1
FIG. 1 illustrates an Incandescent tent filament structure of B-10 candelabra lamp.

FIG. 1 discloses the prior art comprised of a tent coiled-coil filament as used in a B-10 100 B-25, or other decorative lamps of similar form. The tent filament produces light in large bi-directional lobes spherical in nature which emanate from the tent filament in such a manner that the majority of the direction-cosine space from 0-360 degrees in the azimuth direction and 0-180 degrees in the vertical direction. When referring to a light source which produces light in greater than 300 degrees refers to full vertical distribution comprising +/−150 degrees in both the left and right hemispheres. The majority of the optical elements enclosed are symmetrical as desired for omnidirectional light source applications. However, they could be cut in half and combinations of directional and omnidirectional geometric forms can be derived from the seed geometry enclosed to produce highly asymmetric distributions as required for area and specialty application.

Figure 2:
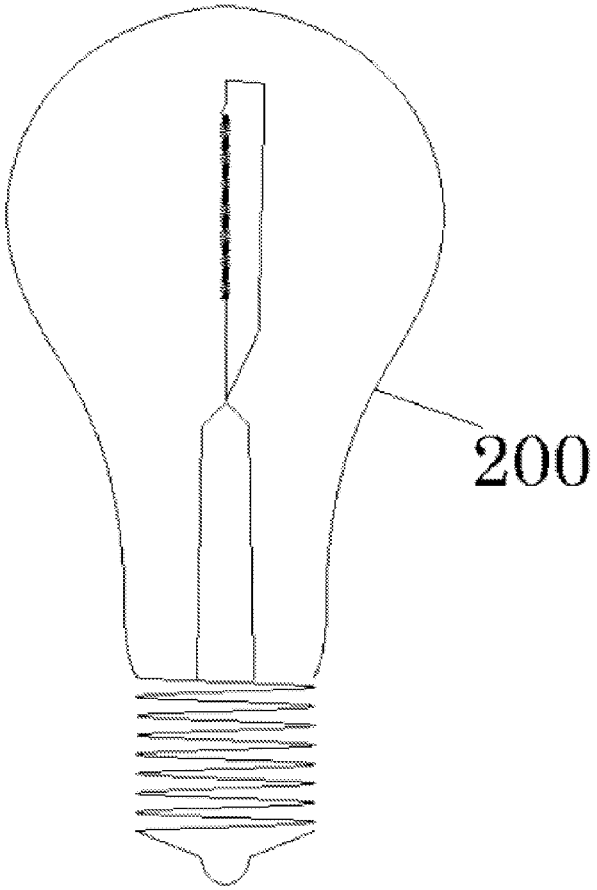
PRIOR ART Figure 2
FIG. 2 illustrates a Vertical Incandescent filament structure of A-19.

FIG. 2 discloses a vertical coiled-coil filament enveloped in an A-lamp 200 glass form factor. The A-lamp NEMA form is ubiquitous throughout the world and critical to its operation is that of the high temperature tungsten filament in when the coiled-coil improves efficiency and distribution through intra-filament light scattering and super-heating. The light emanating from the vertical filament produces omnidirectional light primarily in the left and right hemispheres, with some depression in light distribution directly nadir or 0 degrees in which 0 degrees corresponds to directly above the vertical filament or polar north, and 180 degrees directly below the E26 screw base where no light emerges. Prior art in LED optics has failed to emulate the light produced by the elongated vertical filament in both appearance and distribution.

Figure 3:
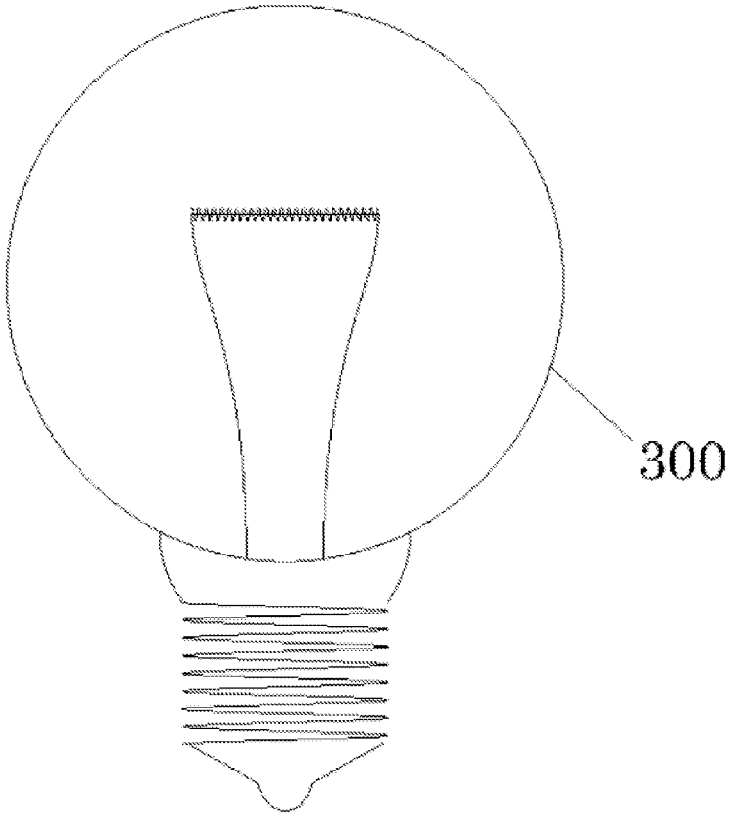
PRIOR ART Figure 3
FIG. 3 illustrates an Incandescent filament structure of G-25.

FIG. 3 discloses the prior art comprised of a G-lamp 300 as used for vanity mirrors and other decorative fixtures in which a horizontal penta-filament produces hemispherical lobes of light to the top and bottom with slight depressions in light distribution laterally to the left and right hemispheres.

Figure 4:
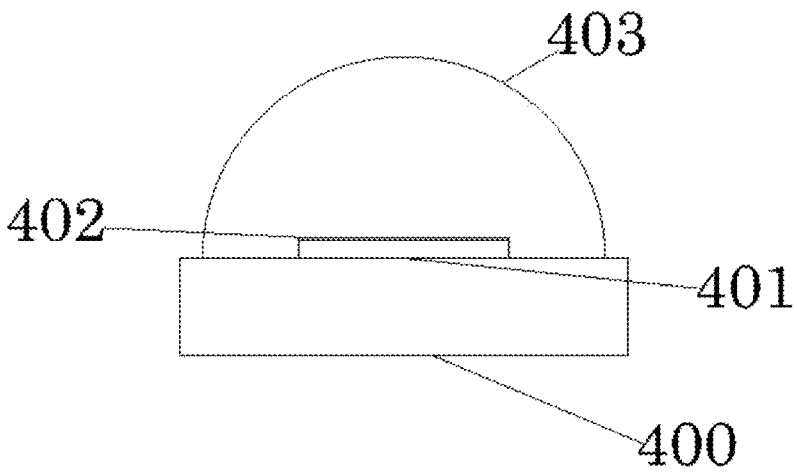
FIG. 4 illustrates a Single chip LED source with phosphor coating or direct bonded luminescent ceramic.

FIG. 4 illustrates a single chip LED source with a phosphor coating or direct bonded luminescent ceramic. 401 is attached through a eutectic process to a copper plated polycrystalline diamond sub mount, natural graphite heat-spreader or aluminum nitride substrate 400. The substrate serves to conduct electricity to the chip and and conduct waste heat away from the chip. The substrate is comprised of materials that have suffucient thermal conductivity to transport the waste heat without exceeding the maximum temperature rating of the chip or other materials. Similarly, the electrically conducting function of the substrate necessitates sufficient electrical conductivity to transport electrical energy and sufficient electrical insulation to prevent a short circuit. The prior art contains many combinationations of thermally conducting, electrically isolating and electrically conducting materials. Common examples are the resin encapsulated lead frame (8 mm, 5 mm and 3 mm standards), plastic leaded chip carrier (PLCC) and chip on board (COB). 402 illustrates a wavelength conversion layer applied through an electrophoretic, conformal deposition process or ingrown laminated to the active material of the LED in the form of a luminescent ceramic or glass. The chip is enclosed in a silicone encapsulant lens 403. The optical component 403 serves to enhance light extraction from the package or to direct the light in a desired direction or pattern. The lens may be a transparent clear or diffuse spherical shaped dome of sufficient size to boost light extraction from chip to outside air. Alternative constructions include freeform-shaped lenses for shaping the emission pattern from the package. Within the prior art, the optical component is also commonly an optical reflector, or a combination of reflector and lens system. The light distribution of the LED is a nearly ideal Lambertian distribution with distribution ranging from −90 to 90 degrees with a full beam angle of approximately 100-120 degrees. In some designs the LED chip incorporates photonic quasi-crystalline structure which boosts luminance by tightening the light distribution to +/−15 degrees which enables projection applications where the acceptance etendue of a spatial light modulator is of concern. The design forms could extend to a laser in when the full resonant cavity directly limits the direction cosines allowed in emission in which case design forms such as powell lenses can aid in the production of highly asymmetric distributions of emanating light. Although the hemispherical light extractor lens is shown, other primary lenses could incorporate TIR elements to directly produce 10 degrees-40 degrees beams nearly as efficiently as a Lambertian beam. With larger chips the primary light extractor could also take on extended freeform shapes described through T-splines, D-NURBS, etc. to produce typell, typelll 90/10, typeV square, or other custom distributions. The problem with the standard LED for general illumination is that it does not produce an omnidirectional beam distribution natively.

Figure 5:
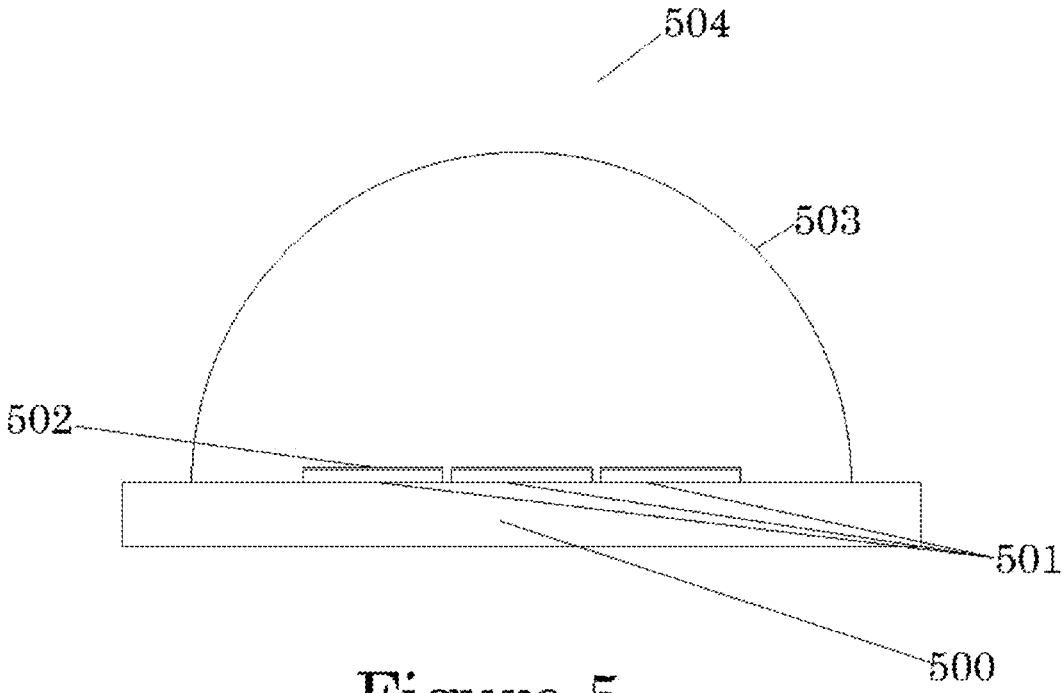
FIG. 5 illustrates an LED source quad chip array.

FIG. 5 illustrates a multi-chip package 500, in which a 3×3 chip array 501 pumps an array of wavelength conversion elements 502, to produce white light. After traversal through a primary light extraction lens 503, the light distribution 504 produced is also of a Lambertian form as in the single-chip case, as it is a direct production of the convolution of the light distribution characteristics of the 9 chips. A 3-chip cross-section shown. FIG. 5 is intended to express flexibility in mixing chips of various wavelengths, i.e. a 3×3 chip array could be comprised of both direct emission monochromatics as well as white light elements to enhance CRI or produce different color temperatures of white.

Figure 6:
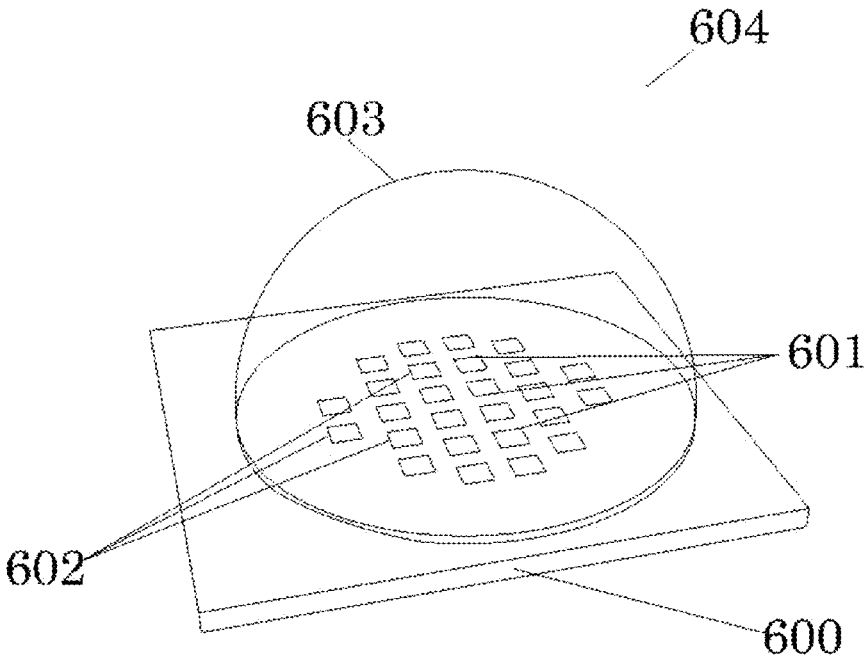
FIG. 6 illustrates an LED source many chips.

FIG. 6 is an expanded version of FIG. 5 in when the package 600 is comprised of multiple LED chips 601 which each pump wavelength conversion devices 602 and are filled into a cavity to extend light production to over 2000 lumens. The primary extraction lens 603 improves efficiency of light traversal from the LED chip or phosphor layer to the air and are typically hemispherical in form, and produce Lambertian intensity distributions 604. The primary light extraction lens 603 may also be designed as a flat geometry with integrated wavelength scale light extractors.

Figure 7:
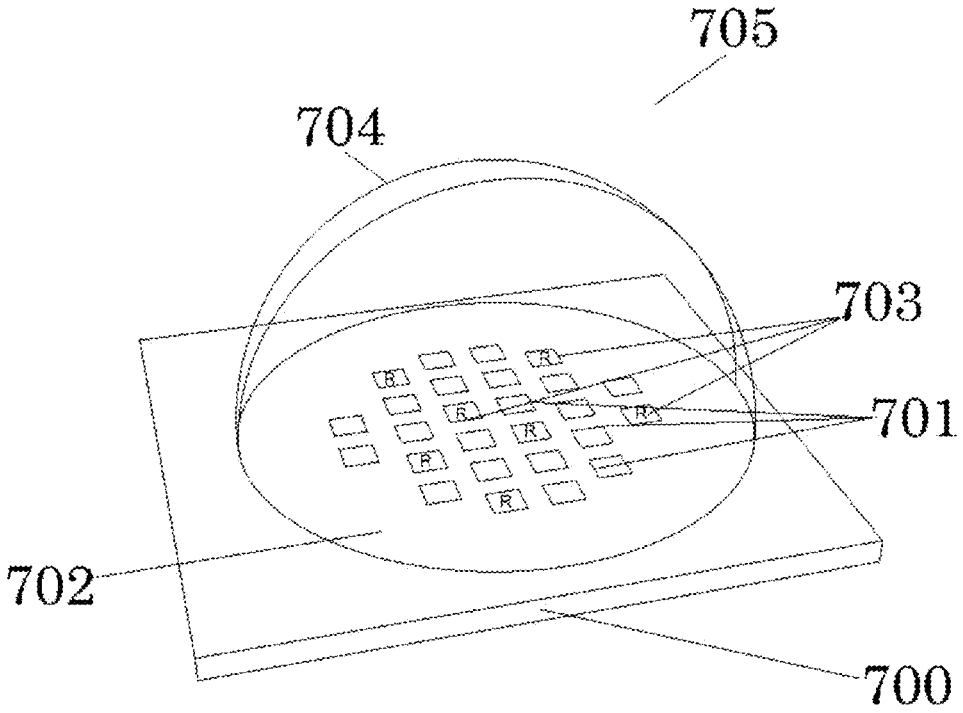
FIG. 7 illustrates an LED sources red CRI boost chips+ 3500-6500 K white chips.

FIG. 7 illustrates an LED array similar to FIG. 6 with the addition of a red chips set which boost CRI in the warm white color temperatures 2500-3500 and produce higher efficiency than multi-phosphors through reduction of intra-phosphor absorption losses. Alternatively, the red could be produced through a high efficiency LED greater than 70% wall plug efficiency grown on bulk GaN which reduces defects and enhances radiometric light output in the longer cyan wavelengths 470-495 which in turn could pump a nitride red luminescent chip directly bonded to the LED thereby reducing the thermal quenching which hampers AlGaInP red chip performance at 85-100 C operating temperatures. Although LED phosphors are now available with narrower emission wavelength bands, still the extended distribution of the LED phosphors allows for finer reproduction of monochromatics and saturated colors in fabric and interior design. In the FIG. 700 illustrates the package, 702 the substrate, 701 the pump chip array, 703 representative of the direct emission chips, 704 the hemisphere light extraction lens, and 705 the primarily Lambertian intensity distribution produced.

Figure 8:
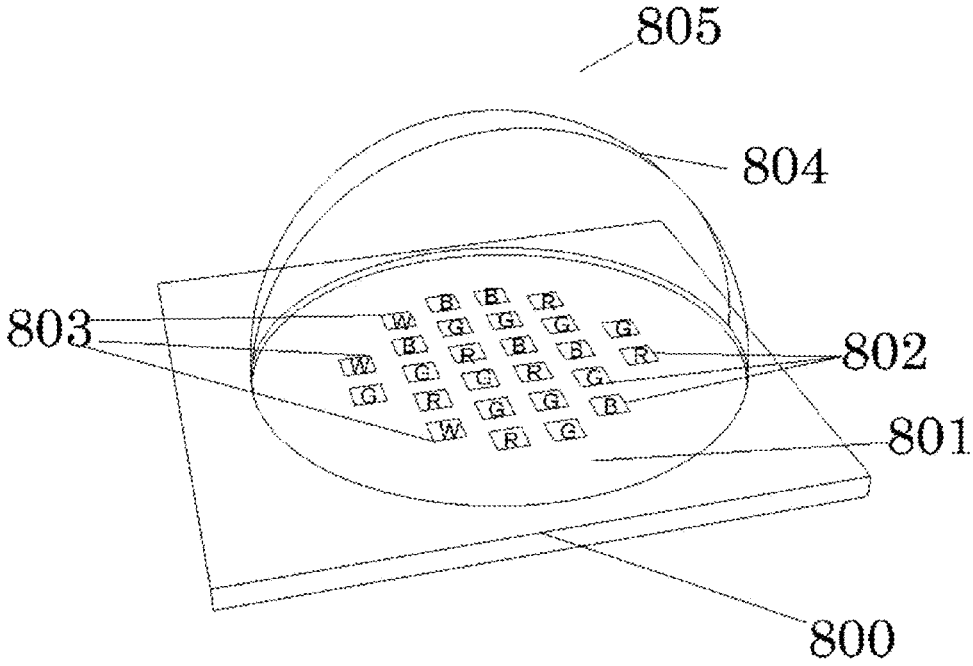
FIG. 8 illustrates an LED multi-chip array with combinations of direct emission r, g, b, violet, cyan or white chips.

FIG. 8 comprises an LED package 800, incorporating a sub mount 801, rgb chip array comprised of many direct emission sources in when the combination of monochromatic light sources produces the net effect of white light 802, and 803 optional white light chips. Although only red, green, blue direct emission chips are shown, other intermediates such as cyan, orange, violet, etc can be added to the array. Again, the primary light extraction element is that of a hemisphere 804, although lower-profile directly monolithic light extractors could also be used over each chip. The net effect is a largely Lambertian light distribution 805. The purpose of disclosing these LED light source form factors FIGS. 4-8 was to illustrate the variety of solid state light sources which could be used to illuminate the multiple-tier dispersion element optic. Solid-state light source could also refer to lasers, resonant cavity LED, OLED, or other light producing junction based devices comprised of quantum wells, quantum dots, whispering gallery, bow-tie, quasi stadium resonance or quantum micro-disks.

Figure 9:
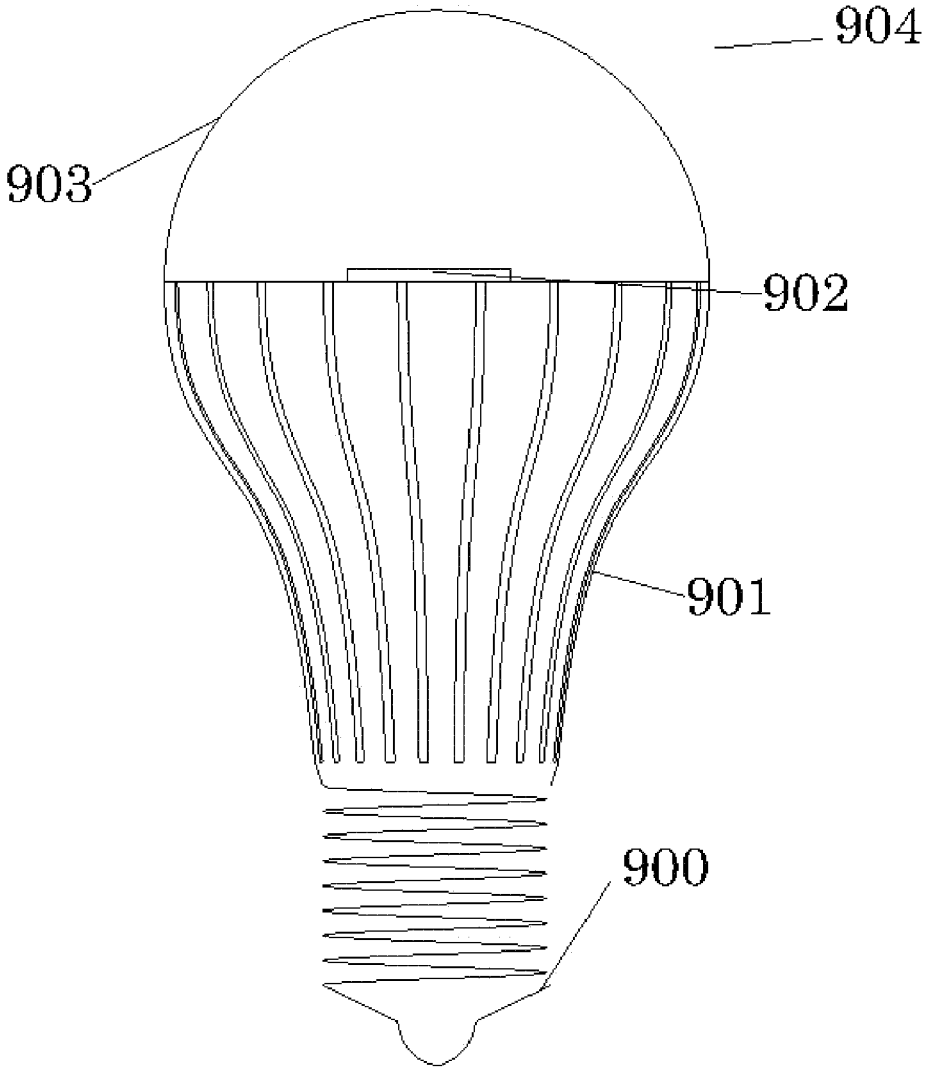
FIG. 9 illustrates an LED lamp comprised of a Lambertian chip on board array and a diffuser.

FIG. 9 illustrates an A-lamp comprised of an Edison screw-base 900, or electrical contact element, a heatsink 901, LED array 902 comprised of individual smaller chip packages, or a larger array package, such as FIG. 8, a diffuser 903 used to homogenize the light production emanating from the LED elements and a light distribution 904 which is slightly wider than Lambertian, likely +/−75 or +/−85 degrees. Primarily the cross-section of the heatsink 901 and the emission distribution of the light sources themselves limit the ability of the lamp to produce omnidirectional light.

Figure 10:
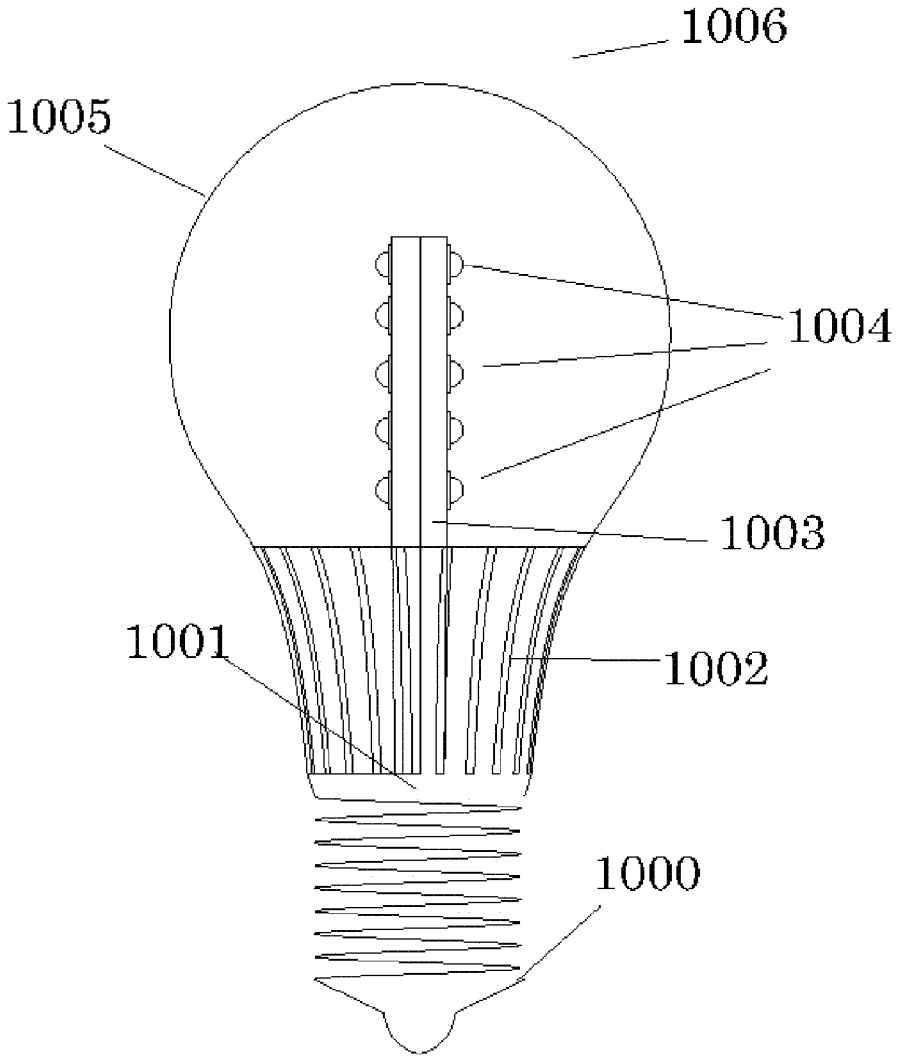
FIG. 10 illustrates an LED lamp in which sources placed on both sides of a vertical board with heatpipe.

FIG. 10 overcomes the distribution limits of the design form disclosed in FIG. 9 by placing the LED's 1004 through SMT laterally on both sides of a thermal heat pipe or metal-core board 1003. The heatsink 1002 still cuts-off the distribution of the light source, while enclosing driver and dimming electronics 1001, and a screw base 1000 or other electrical contact device. The net effect is still only possible of producing light up to 250 degrees or +/−125 degrees vertically. This form factor also has a reduced light output directly nadir or 0 degrees. The solution represented by FIG. 10 represents an intermediate design incorporating no optical light control.

Figure 11:
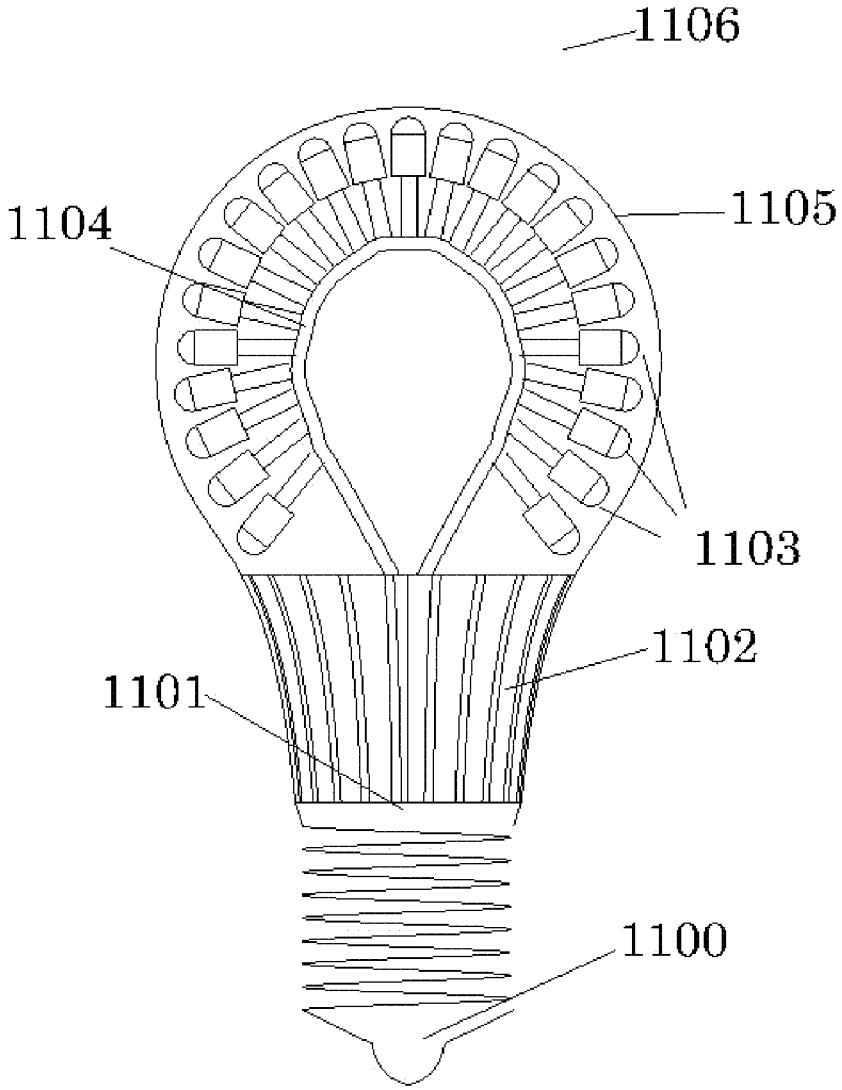
FIG. 11 illustrates an LED lamp comprised of a tree of 5 mm LEDs.

FIG. 11 includes an electrical contact 1100, a heatsink 1102, driver and dimming electronics enclosed 1101, and a flexible PCB 1104, upon which are attached many small LED's, such as the 5 mm LED's shown 1103. A diffuser glass shown 1005 is used to boost uniformity of the light output. Placed in a circular pattern the strips of LED's will produce light in many directions 1106 greater than 300 degrees. However, due to severely restricted heat dissipation capability, the lamp will not be able to produce the 800-1200 lumen light output required to match a 60 W or 75 W incandescent light bulb. Lifetime could still exceed that of an incandescent lamp today. As shown multiple-strips of these outer-facing LED's will be required to produce light to fill the full 360 degrees azimuth direction.

Figure 12:
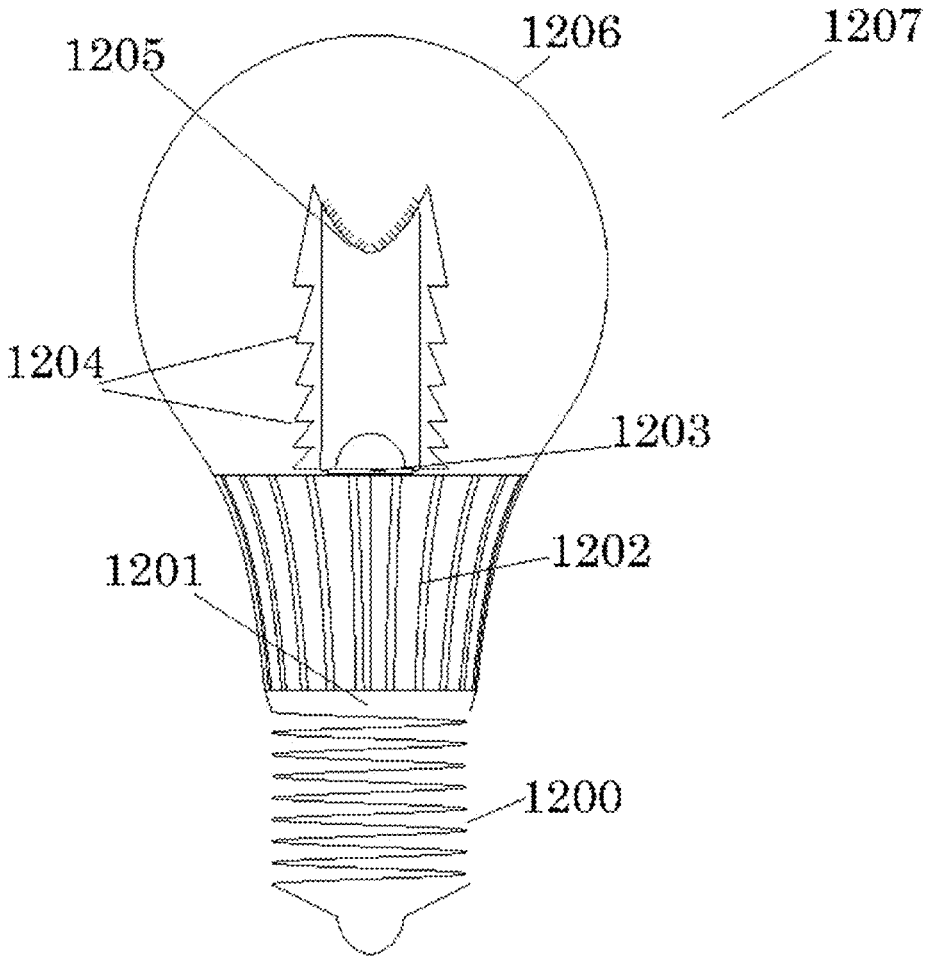
FIG. 12 illustrates an LED lamp with side emission optical reflector/refractor.

FIG. 12 illustrates a screw base 1200, a heat dissipation device 1202, enclosing driver and dimming electronics 1201, a multi-chip LED array 1203, and an optical device comprised of two classes of optical control, TIR prisms 1204, and a metalized reflector section 1205. The net light distribution effect 1207 after passing through the glass envelope or diffuser 1206, is that of a butterfly light distribution in which butterfly refers to light which spreads laterally well, but has depressions of light distribution both above the optical element and limitations in distribution below due to the heatsink cross-sectional area occlusion factor.

Figure 13:
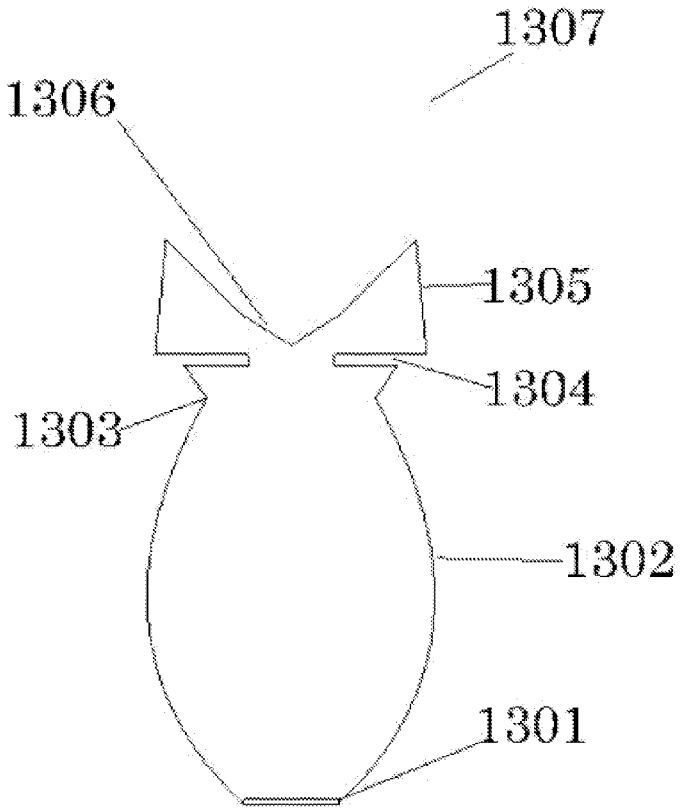
PRIOR ART Figure 13
FIG. 13 illustrates a Confocal elliptic concentrator with V-tail extractor.

FIG. 13 illustrates a prior art solution to the production of semi-omnidirectional light in which LED light produced by a single chip 1301 is directly coupled to a single ejector section by means of a confocal elliptic concentrator 1302. The light transfers from square to square or from point to point to produce a secondary light source point at the upper part of the confocal elliptic concentrator 1303. At that secondary light source point a single tier of ejector section with an air-split device 1304 ejects light into a substantial solid-angle by means of the classical TIR "v" tail 1306 side emission design. The TIR "v" 1306 and its air transfer surface 1305 has been used for many side-emitter applications for illuminating backlights for displays, for runway lights, and for outdoor beacon lighting. The genius of this prior art solution rests solely on the design of a single ejector section and is tailored towards lower brightness single chip devices. The distribution of light produced 1307 is much wider than a stock Lambertian LED.

Figure 14:
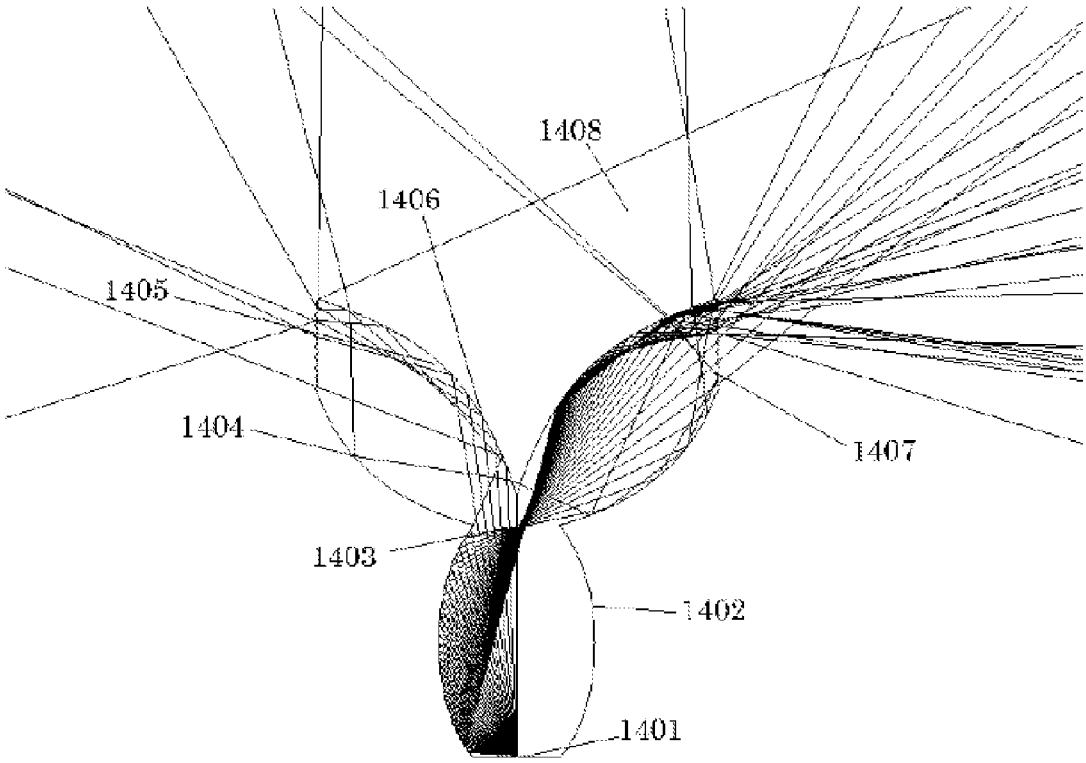
PRIOR ART Figure 14
FIG. 14 illustrates a Confocal elliptic concentrator with whale-tail extractor.

FIG. 14 illustrates a second prior-art optical solution to the production of omnidirectional light in which a single chip LED 1401 directly transfers light to an equiangular spiral or confocal elliptic concentrator 1402. The confocal elliptic concentrator 1402 transfers light from the source to a secondary source point at 1403. At that point the light enters a single wide ejector section 1404. This whale tail, or rabbit ears geometry is typically comprised of a second equiangular spline 1406, or biconic polynomial which is easier to describe using first-order analytic design tools such as MS excel or orthonormal surface tools incorporated in many modern cad packages. The single ejector section utilizes pure TIR 1406 to transfer light to the side. On the side or outer surface micro-lenslets, facets, or ridges are employed to help to caustic induce light dispersion into a wider solid angle 1408. A few limitations include the depression of light intensity nadir or polar north of the light source. Many lights require uniform illumination directionally near-field to the source.

Figure 15:
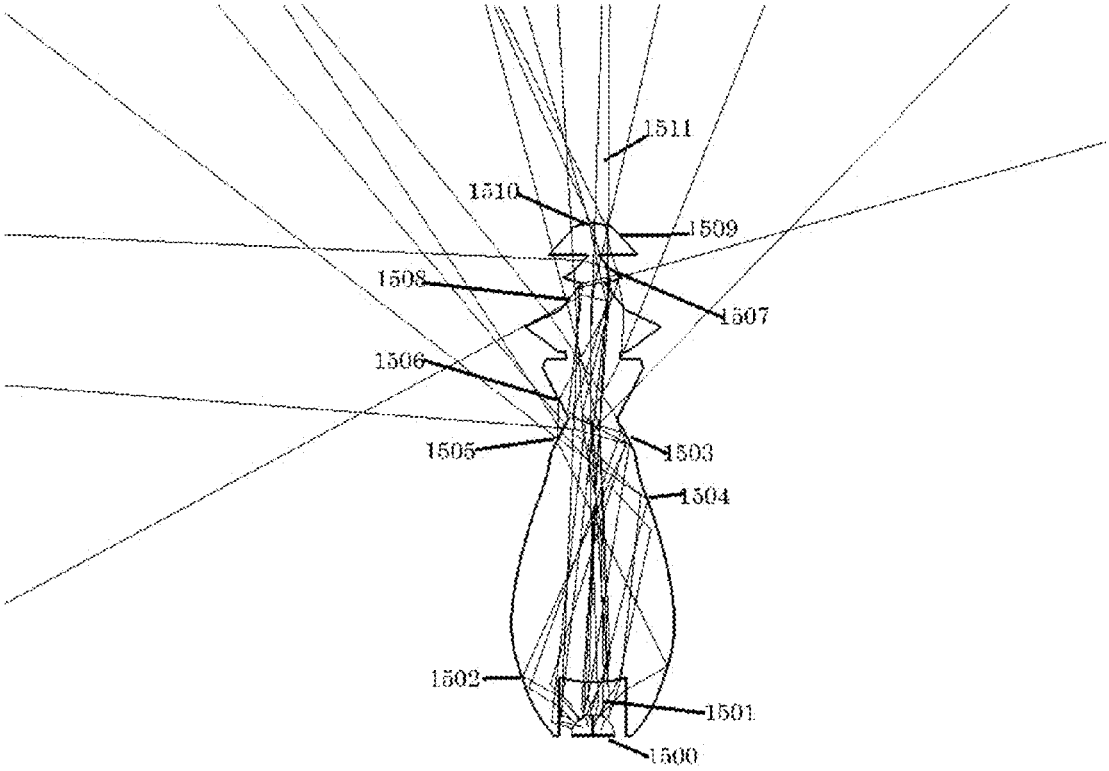
FIG. 15 illustrates a Source to Line Concentrator with multi-stage light guide fed multiple tier light distribution elements 1.

FIG. 15 illustrates the raytrace of a multiple-tier TIR/refractor solution which efficiently collects light 1501 from the LED light source or array 1500 disclosed in FIGS. 4-8 above. Three critical parts of the invention include; the source to focal line concentration or SLC by means of a TIR lightguide; the secondary stage internal core light-guiding which feeds the final novel part of this invention; that of the multiple-tier refractor/TIR elements used to produce omnidirectional, butterfly, or custom direct/indirect light distributions. A tier may be described as a level of optical structure one above another sequentially or in rank based upon the percentage of light upon which it operates. However the light paths are entirely non-sequential in spatial direction. For example if light proceeds in the outward direction from Z=0 mm upwards through the central lightguide to a second stage lightguide before finally striking the last tier in the optic at Z=55 mm the light may then back flow down through a lower tier via internal light-guiding before exiting to the air to produce indirect light. Alternatively, the light may reverse direction −Z at an intermediate tier, then pass externally through the air before perturbation via reentering a lower tier or refracting laterally to produce fill light. The free-form spline TIR or metallic reflector lightguide then redirects the light bundles emanating from the chips to second and third TIR redirection surfaces 1503 and 1504 respectively. The illustrations of multiple-tier elements serves as an example, but not a limitation to the number and shape of the tiers disclosed. Discrete line segments are used for example for tier dispersing elements, but weighted b-splines, bernstein polys, or reduced control point local-refinement t-splines and other polynomial classes, algebraic surfaces, sheaves, or manifolds are also possible. Rotational symmetry is shown in the Figures but is not a limitation, as lofted cross-sections which do not have rotational symmetry may also serve to guide and direct light. TIR is an optical operation disclosed but a metallic reflector for all or part of the light-guiding may also serve the same purpose. 2, 3, 4, or 5 multiple-tier optical elements are disclosed, but 1000's of tiers may be used to direct light with fine control into sub 1-degrees intensity zones. Multi-stage lightguides which use a single internal trunk are disclosed but hydra multi-channel lightguides are also possible each including multiplie tiers and may be configured to emulate the tent filament of the B-10 incandescent. Stage when defining a lightguide system refers to a smaller lightguide at a higher level in the optic fed through a central or bifurcated lightguide trunk or main stage. Alternatively, the smaller lightguide at the top of the optic which feeds the light dispersion tiers may be split into two or many lightguides each carrying a smaller percentage of the light used to feed TIR/refractor tiers. The light traverses a spline light guide for two purposes, to keep the light or heat source closer to the center of the of heatsink to allow for two heatsink sections to double the thermal dissipation area both surrounding the lightguide and underneath the lightsource thereby allowing the LED to produce more light. In other words a second upper thermal dissipation device may surround the lightguide up to the sections where light disperses to the air. The thermal heatsink occlusion is overcome through the light guiding through the central core of the LED lamp to points towards the top of the lamp. This increases the indirect lighting capability of the light emission source and enhances the complete omnidirectional dispersion capability of the light source.

As shown the TIR light guide element 1504 then forces approximately 50% of the light to refractively exit at surface 1505, while some of the light re-enters the optic at a second tier refractor at 1506 before traversing to a $4^{th}$ TIR dispersion device at 1507. Element 1506 acts to refract light and TIR lightguide in the forward direction to feed the succeeding tiers of optical elements. The 1507 TIR element throws light downward, and works in tandem with elements 1508 and 1509. These light dispersion tiers further throw light into downward and lateral intensity zones. Finally element 1510 controls the remaining light which has passed through the center of the lightguide to provide more light directly above the lamp 1511. The lightguide and multiple-tier dispersion optical elements may be manufactured from many different optically clear materials such as Makrolon polycarbonate LED2245, acrylic Altuglas HT121, B270 glass, or high durometer injection molded silicone. The lightguide may also be comprised in whole or in part of a 98% reflective white lambertian or oren-nayer scattering material to provide additional color mixing before feeding the higher stage lightguides and multipler dispersion tiers.

Figure 16:
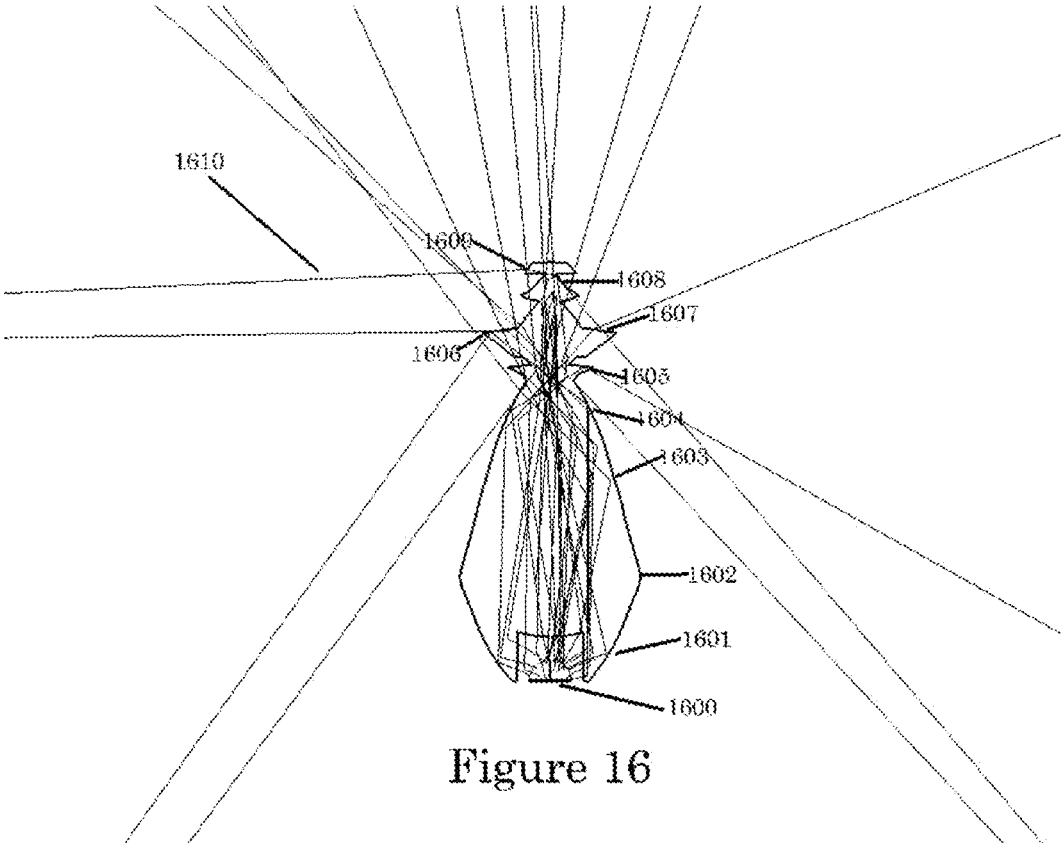
FIG. 16 illustrates an SLC with dual-stage light guide fed multiple tier light distribution elements 2.

FIG. 16 illustrates a second multiple-tier omnidirectional optical solution which serves the purposes of throwing considerable light both upward and downward with less emphasis on lateral throw of light. Light emanates from LED source 1600, before collimating through TIR element 1601. At zone 1602 of the spline light guide the light density is reduced to allow for attachment and holding within the light fixture or lamp. Light then reconcentrates through the combined effect of TIR elements 1603 and 1604. Elements 1603 and 1604 are primarily responsible for producing the focal line concentration whose primary function serves to feed the upper multiple tier dispersant elements. Very little light is allowed to leak out the lightguide at 1604 or 1605, rather the light is directly injected into the multiple-tier TIR/refractor elements located at 1605, 1606, 1607, 1608, and 1609. Each of these elements including the major element at 1506 serves the purpose of redirecting light upward and downward uniformly and efficiently, each tier filling intensity zones. The optic is 90% efficient at redirecting light from the LED into an omnidirectional distribution 1610. This light source produces a distribution of greater than 300 degrees.

Figure 17:
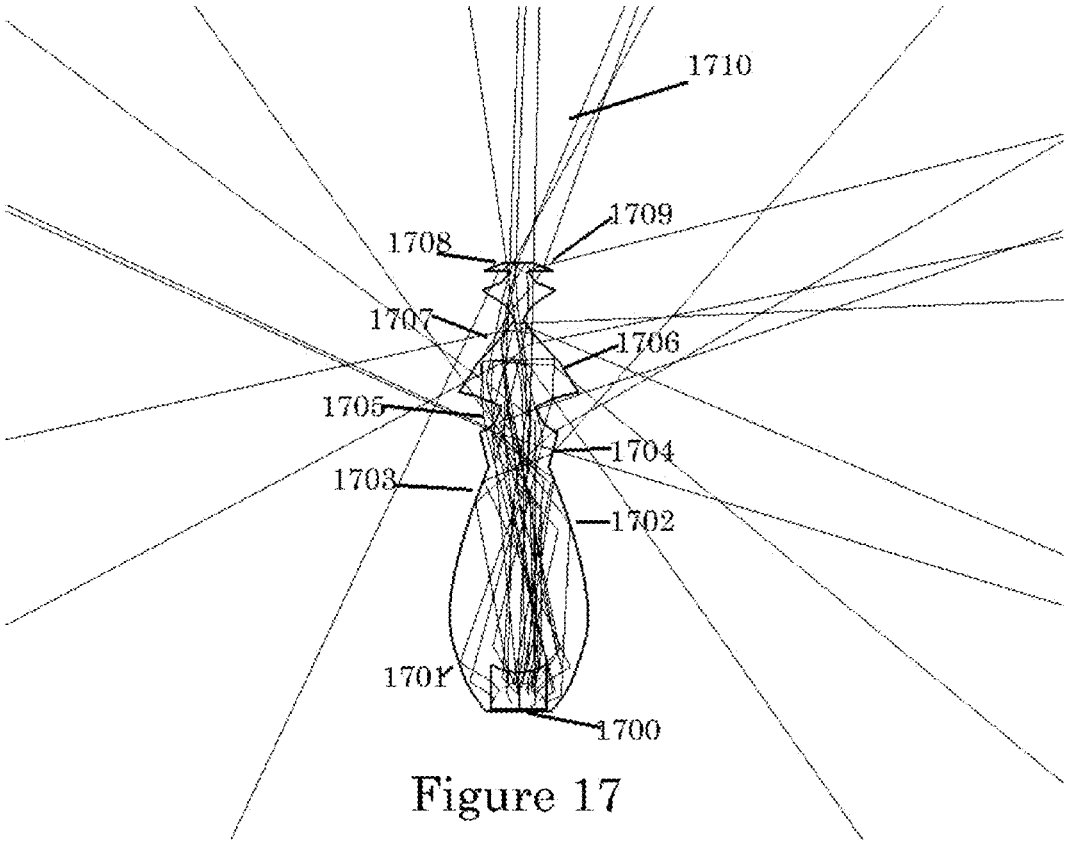
FIG. 17 illustrates an SLC with multiple-stage internal light guide and external refractor fed multiple tier TIR/refractor light dispersion elements 3.

FIG. 17 is a $3^{rd}$ omnidirectional optical solution set which works well with a larger LED source 1700 comprised of a 3×3 chip array such as FIG. 5. Light first traverses a TIR collimation process through the spline geometry at 1701 which directly focuses the light through TIR elements 1702, and 1703. The purpose of focusing the light is not to a secondary source point but rather to force astigmatic line aberration with which to inject light into refractor elements 1704, and the air notch at 1705. Light which exits above element 1704 re-enters the light guide above 1705, before back reflecting through the major TIR element at surface 1706. Light can then re-enter a $2^{nd}$ time at surface 1707 before both refracting and TIR back-reflecting at elements 1708 and 1709. With each of these refractor dielectric to air or air back into refractor transitions light exiting a lower tier and then re-entering an upper tier will undergo splitting through Fresnel reflections which only adds to the uniformity and filling of many direct/indirect and lateral light intensity zones. Many of the primarily TIR surfaces 1706, and 1708 also serve as exit light refractors due to the multiple-paths of light flow through the optic. The net effect 1710 is to produce a light distribution which fills space in an omni-directional manner emulating that of a vertical, tent , or penta filament incandescent light.

Figure 18:
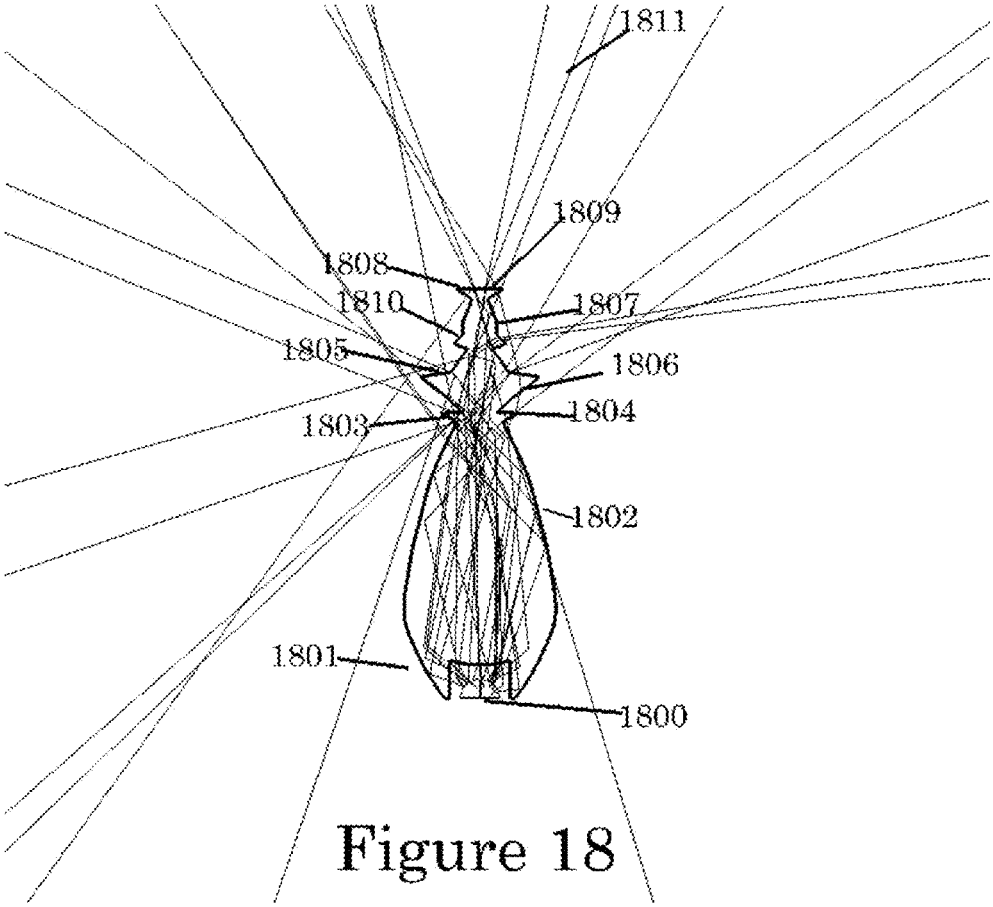
FIG. 18 illustrates an SLC with distribution elements 4 comprised of primarily internally fed multiple-tier TIR/refractor element tree.

FIG. 18 is a 4th omnidirectional optical element set which produces a 340 degree light distribution. The LED array at 1800 ideally produces 1000 lumens of warm white light, 2700-3100K, at 90CRI, with an efficiency of 125 lumens/Watt thereby reducing the size of the heatsink required to achieve good lifetime in the lamp without optical occlusion of the light produced by the preferred embodiments of this invention. The distribution pattern produced by 1800 is typically Lambertian after wavelength conversion through a phosphor layer. Micro-lenses attached monolithic to the chip or luminescent glass are also possible to narrow the beam off the chip and increase luminance. Increasing the luminance of the chip serves to decrease the size of the lightguide required and increase light transfer efficiency. The TIR collimation element at 1801 redirects light to TIR spline 1802. 1802 feeds light up through a narrow neck with sufficient peripheral dispersion necessary to back reflect through TIR at the tier element 1803. Some light will also exit the optic at 1804 to either fill an upward intensity zone or to re-enter the optical dispersing element at a subsequent tier such as 1806. The light refraction incident and exiting surface at 1805 disperses light laterally with the astigmatic light rays on the periphery which have traversed the first tier element. After undergoing split redirection either to TIR back reflect or to forward traverse after refraction into an upward intensity zone. TIR element 1807 is unique among the omnidirectional optic sets because its construction constitutes a secondary lightguide element which feeds the backreflecting 3rd TIR tier 1808. Refractor elements 1805 and 1810 have additional capability to redirect internal light energy to the outside. Final element surface 1809 is shown flat but may have curvature, or ridge lenslets incorporated to uniformly illuminate the upper intensity zone of light 1811. The distribution of light 1811 is a full 340 degrees distribution with sufficient light to fill most light zones required for omnidirectional lamps.

Figure 19:
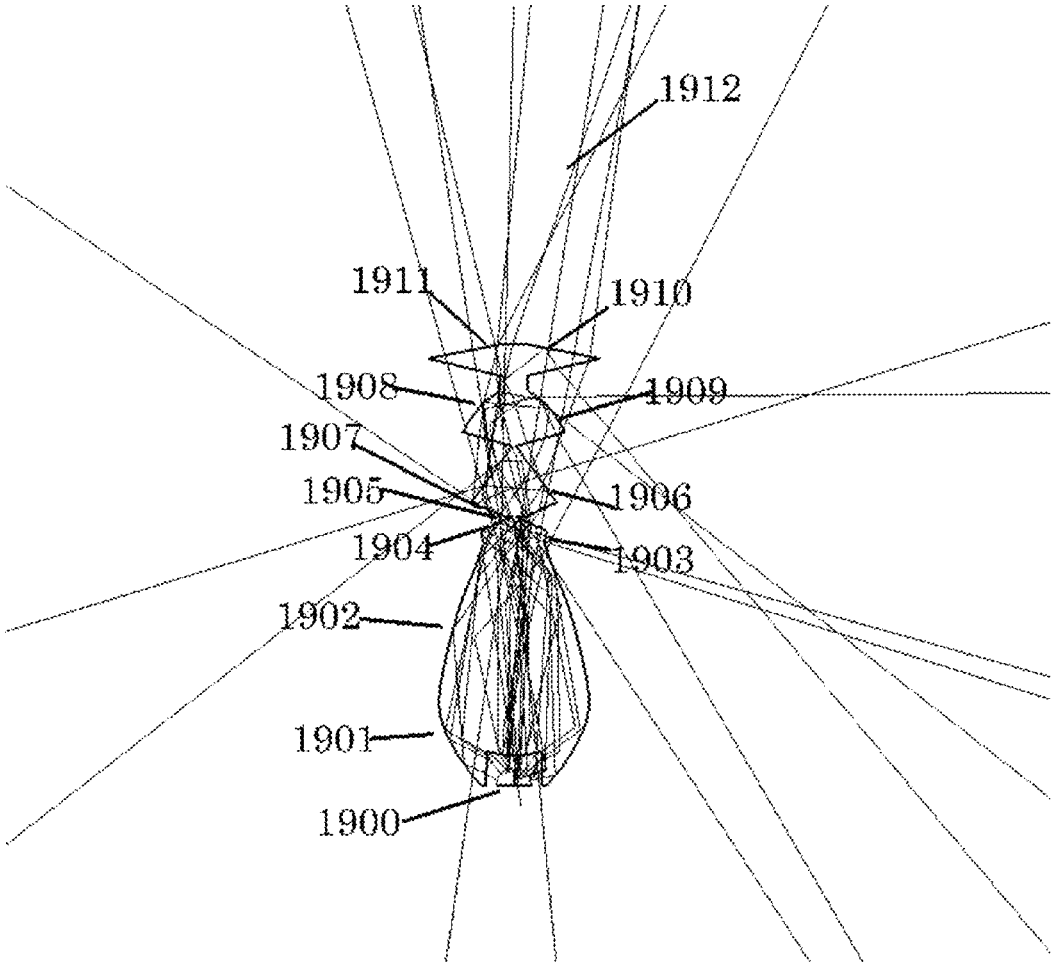
FIG. 19 illustrates an SLC with primarily externally refractor fed multiple-tier TIR/refractor element tree 5.

FIG. 19 illustrates a 5th set of omnidirectional optical elements comprised of a system of both lightguide, and multiple tier light control elements. Light source 1900 may be comprised of multiple direct emission chips and phosphor converted light emission elements. Although a hemispherical primary light extraction device is shown attached to the LED array 1900, alternative primary light extraction lens shapes may be used to narrow the Lambertian beam into a 60 degrees beam. Alternatively, a light dispersion micro-optic or volumetric diffuser may be attached to the primary light extraction lens at 1700 to recycle and mix the light colors. Lightguide TIR surface 1901 guides and redirects light to control surfaces 1902 and 1903 to a refractive light director 1904 which refracts forward light upwards through tier elements 1906, 1909, and 1910. In the FIG. 19 configuration the majority of the light greater than 80% exits the lightguide completely at element 1904 and traverses through air 1905 before entering again at the incident surface of 1907 and 1906. Surface 1907 directs light downward as well as refracts light in a light conditioning step before passing through the incident surface immediately preceding TIR/refractor element 1908. TIR/refractor element 1908 pushes light outward to primarily lateral intensity zones. Light which does not TIR back reflect or laterally escape, may re-enter and TIR back reflect at surface 1910. More light may redirect in the upward intensity zone at surface 1911 before ultimately producing the final intensity distribution 1912. Primarily the distribution 1912 throws light upwards and laterally, with less emphasis on backward light fill.

Figure 20:
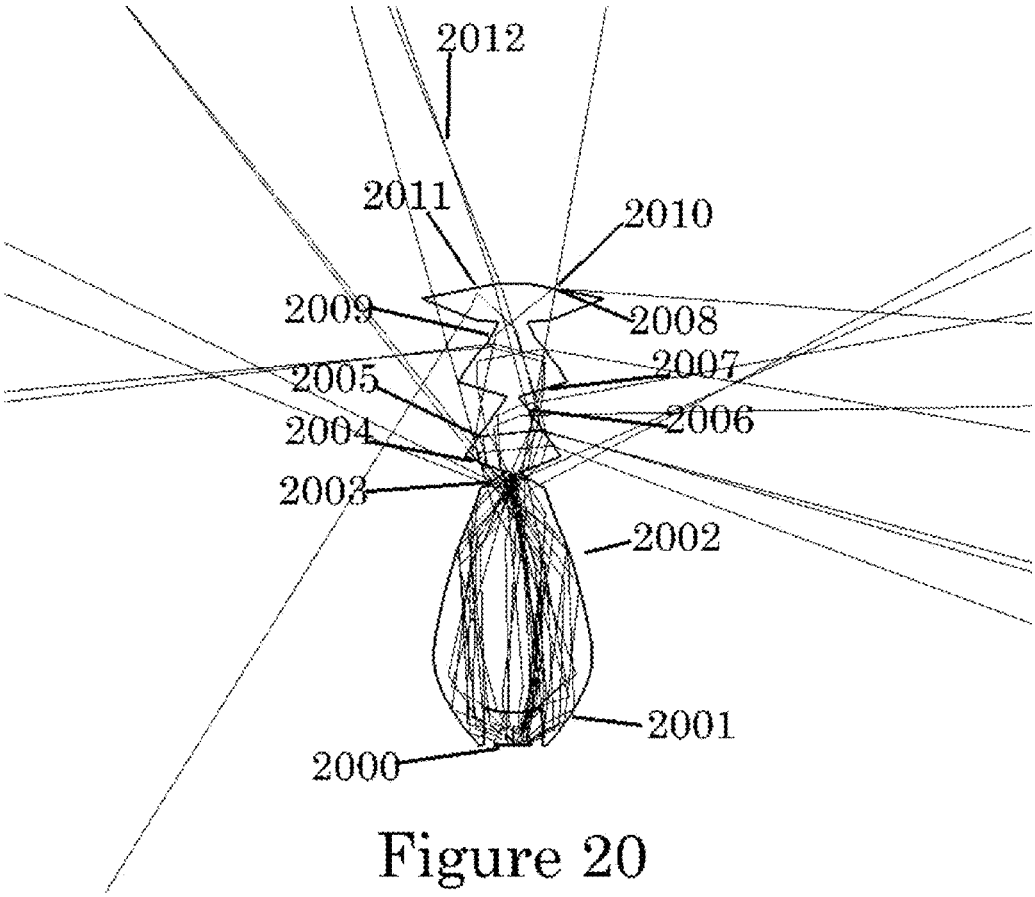
FIG. 20 illustrates an SLC with primarily externally refractor fed multiple-tier TIR/refractor element tree 6.

FIG. 20 is an omnidirectional light element comprised of a light source 2000, TIR spline concentrator 2001, astigmatic TIR light focusing element 2002, and then a series of multiple tier optical devices which redirect light uniquely. In this configuration the majority of the light greater than 90% exits the lightguide and traverses multiple air layers interspersed between combinations of refractor and TIR surfaces. The light exits a refractor control surface 2003, passes through air then re-enters at 2004 before side reflecting at 2005, and 2006. Some light is not side reflected and traverses through an air gap to re-enter at 2007 after which light bundles interact with a second TIR/refractor 2008 and 2009. Finally the last % of light internally guided through the optical element enters and TIR back reflects at surface 2011, or refracts laterally or directionally forward as illustrated by surface identifiers 2008 and 2010. Whereas previous optical configurations performed most of the TIR back-reflecting with the first tiers of optical control elements, the system depicted by FIG. 20 is unique in the sense that it performs the majority of the back-reflection operation using tiers at the end of the element train or group.

Finally, the resulting light distribution 2012 is primarily upward and lateral, with some degree of indirect light distribution to produce a pleasing light effect. Pleasing refers to a light distribution which is both uniform, i.e. not containing large dips in intensity or dark areas, and of a high quality white, in which white refers to a composite chromaticity near the blackbody curve, with sufficient spectral distribution that a high color rendering index is produced. However pleasing distribution does not require full omnidirectional distribution in all cases. Split distribution is also possible with this multiple-tier optical element approach in which all of the light may be redirected upward and downward with far less lateral emission. Pendant luminaires may require this distribution characteristic to simultaneously illuminate a ceiling above and a task surface below with reduced lateral glare.

Figure 21:
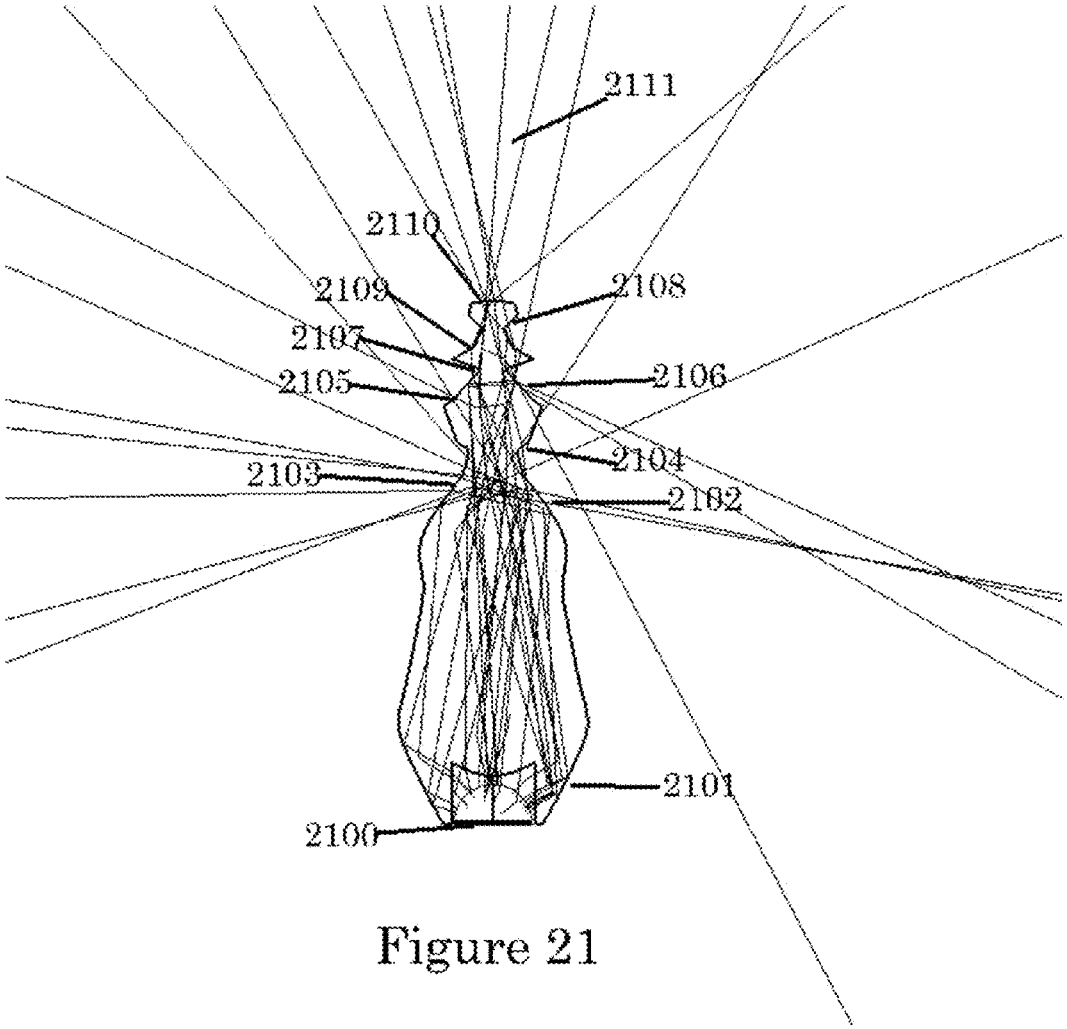
FIG. 21 illustrates an SLC with secondary TIR/refractor emission section coupled to multiple-tier TIR/refractor tree dispersion element tree 7.

FIG. 21 illustrates an optical light-guiding element which takes light from source 2100, and then concentrates using surface 2101. Surface light control elements 2102 and 2103 TIR reflect and refract laterally. Closer towards the upper part of surface 2104 the light can refract upward more. The majority of the light in the configuration shown in FIG. 21 is directed from the inward light guide core outward, and has little re-entrance light. TIR/refractor surfaces 2105 and 2106 complement the 2102 and 2103 control surfaces to fill more indirect light zones. The narrower section at 2107 serves to frustrate TIR light and to push the light outward to the side. A small percentage of light escapes and re-enters for further control in the forward direction by means of 2109 and outward refracting surface 2108. The aspect ratio of element 2109 can be changed to produce more extreme back reflecting light as required. Surface 2110 controls light from directly upward 0 degrees out to 30 degrees off nadir constituting an upward direct illumination zone. The distribution 2111 ultimately produced is omnidirectional with emphasis on direct and lateral illumination with a larger percentage of backreflecting light than FIG. 20.

Figure 22:
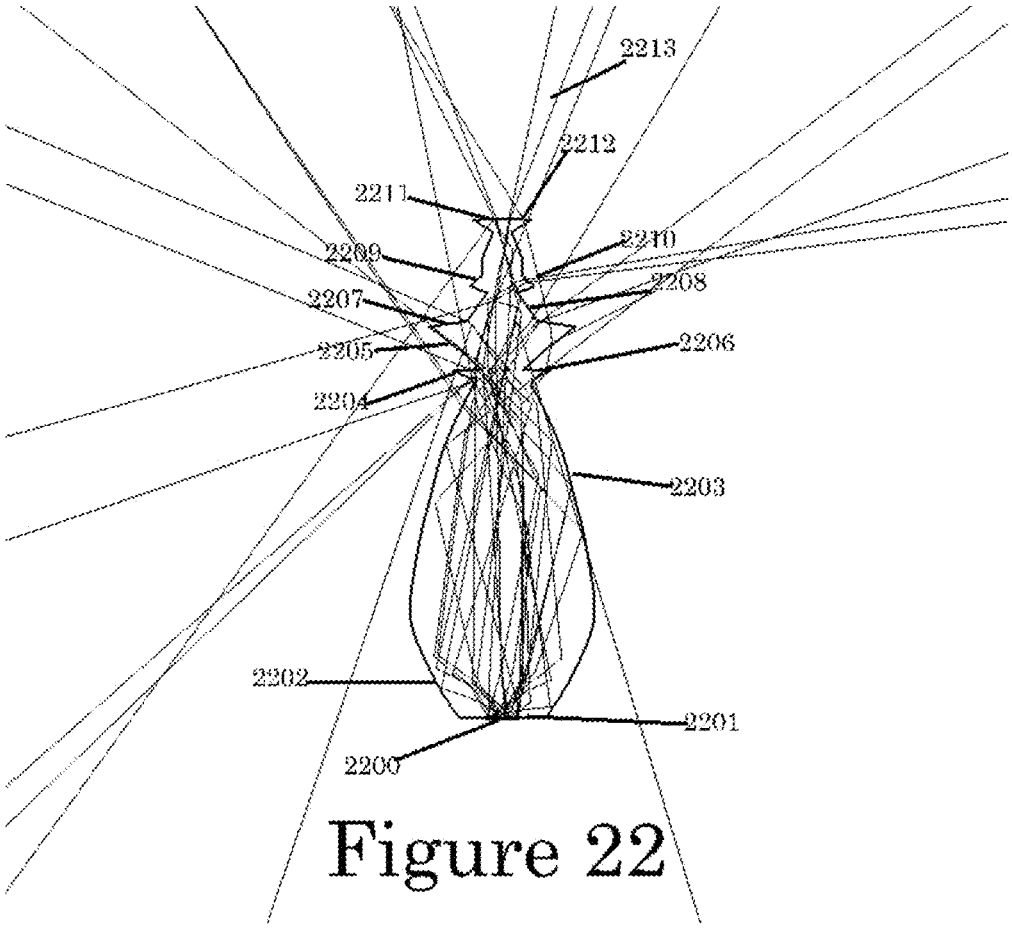
FIG. 22 illustrates an SLC+Multiple tier light distribution elements with direct coupling to LED package—no air gap dome.

FIG. 22 is similar to FIG. 18 with the exception that the optic is directly coupled 2201 to the light source 2200 with no airgap. TIR collimation at 2202 directly reflects light to the 2203 surface for highly astigmatic light spreading through the core of the lightguide. Direct coupling of the light control element to the light source increases system light transfer efficiency by 3-4% by removing the dielectric/air/dielectric interfaces and the respective Fresnel split light which may absorb near the chip or surrounding package components. The purpose of producing strong aberrations which spread the light linearly up the lightguide upper tiers is 1 to more closely emulate the light emission sparkle produced by a vertical incandescent filament, and 2 to feed the light control elements 2204, 2205, 2206, 2207, 2208, 2209, 2210, 2211, and 2212 which produce the ultimate omnidirectional light. Element 2204 back-reflects, 2206 refracts light through air back into the optical element material at 2208, where it then enters a 3rd time at 2212. Element 2210 throws light laterally, while just above a third minor lightguide feeds elements 2211 and 2212.

Figure 23:
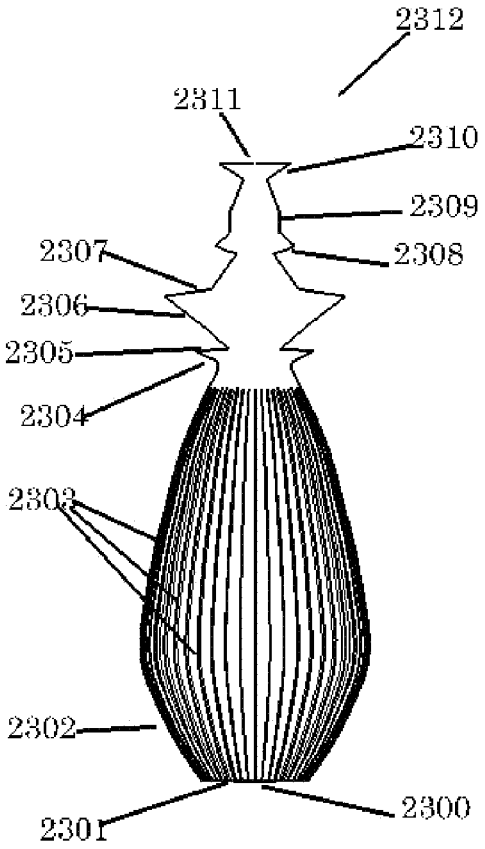
FIG. 23 illustrates a spline light guide with ridges for mixing light+multiple-tier distribution elements

FIG. 23 illustrates the enhancement of the geometry of FIG. 18 with the inclusion light mixing ridges on the outside of the lightguide surface 2303. This is necessary for light sources disclosed in FIGS. 7 and 8 in which direct emission primary wavelengths require mixing. Light mixing ridges or TIR flutes serve to mix light of different wavelength to produce a more uniform light distribution with respect to chromaticity over angle. Well mixed light has a light spectral dispersion on the chromaticity grid of <0.004 du'v', in which u'v' refers to the chromaticity space, and 0.004 the amount of chromaticity dispersion from the composite center as seen within an angular range 0 degrees directly upward to completely indirect 180 degrees from nadir as seen through a virtual axis passing down through the light source. Mixing light ridges 2303 do little to mix the light which travels through the core of the lightguide which is a limitation. Light source 2300 directly couples to the lightguide at 2301, before collimating through ridged collimator 2302. Light ridges 2303 mix light transverse to the light flow direction before striking the TIR surfaces at 2304, backreflecting at 2305, redirecting at 2306, or upward refracting at 2307. Surface 2308 may simultaneously back reflect and refract light upward through the 20-45 degrees intensity zones. Element 2309 feeds a secondary lightguide section before final back reflection and forward emission through elements 2310 and 2311. The composite light distribution 2312 is omnidirectional+more uniform in chromaticity than the design disclosed in FIG. 18 with a minimal impact on transfer efficiency. However this is highly dependant on the quality of the finish on the ridges. Specular, SPI-A1 finish is best in when the surface Ra is better than 6 nm rms.

Figure 24:
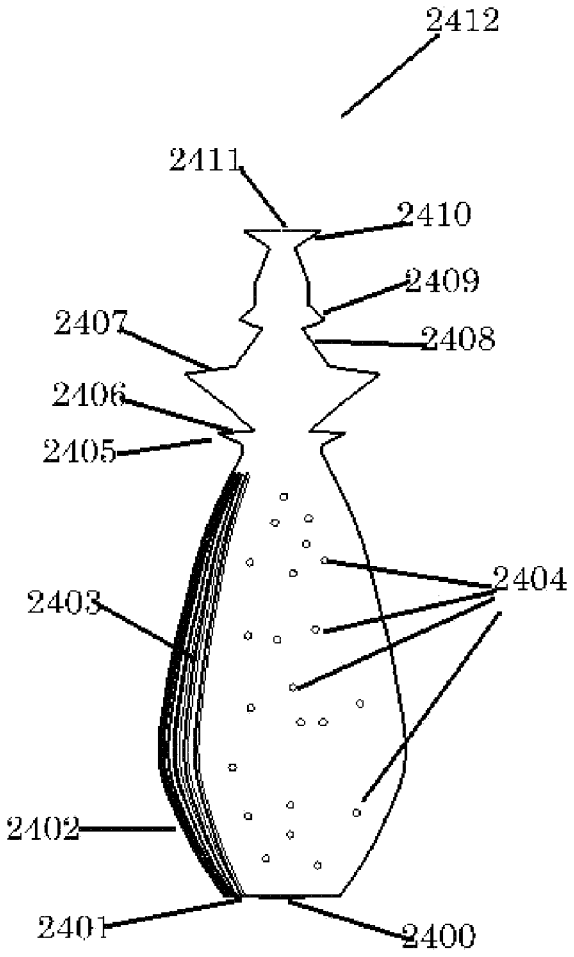
FIG. 24 illustrates a spline light guide with exterior ridges for mixing light+internal micro-refractive particles

FIG. 24 depicts the configuration of either FIG. 18, FIG. 22, or FIG. 23, with the addition of micro refractor particles 2404 which are comprised of an index of refraction which is higher or lower than the host material from when the light guide element is produced. The light not mixed through the light ridges on the periphery can be mixed through the light particles dispersed through the center of the lightguide. For more mixing, a higher density of light particles may be necessary. The index of refraction of the particles should be different than the host. For example if the host material of the lightguide is PMMA index 1.49 at 589 nm, then an appropriate index of refraction for the micro-particles is 1.53 or 1.57. Higher difference of refraction between the host and micro-particles results in more aggressive color mixing/unit length, and reduced mean free path or length traversed by the light before encountering a perturbation in directional flow. However if the index of refraction difference is too high greater than 0.8 difference then too much light will back reflect within the lightguide and never reach the dispersing elements 2405, 2406, 2407, 2408, 2409, 2410, 2411. Micro-particles 2404 may replace the micro-ridges of FIG. 23 entirely, or the two devices may be used together to produced increased color uniformity.

Figure 25:
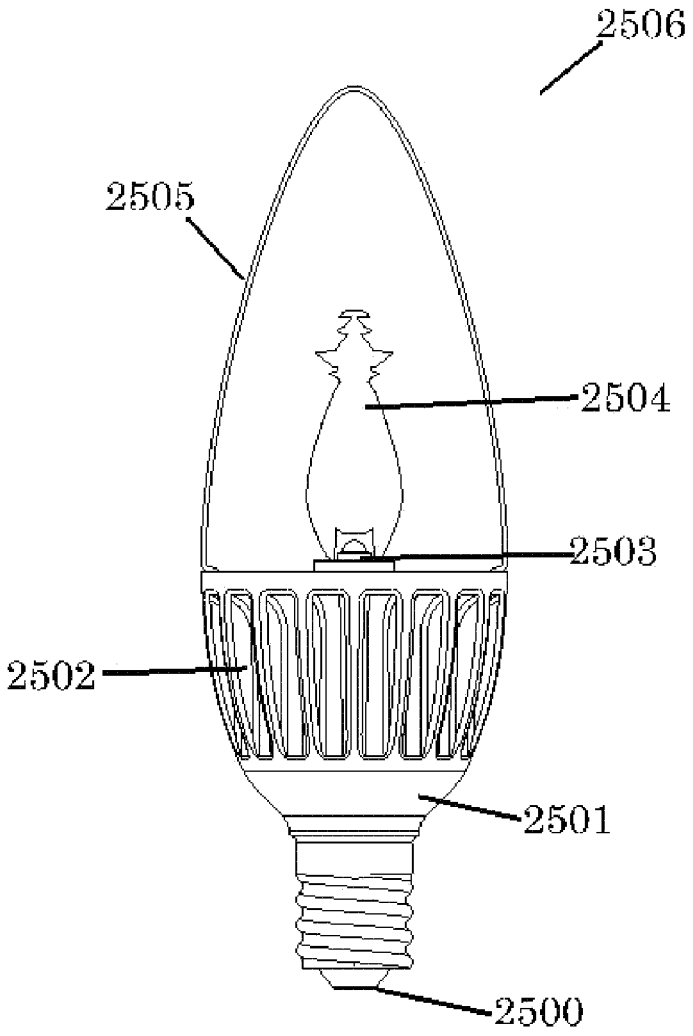
FIG. 25 illustrates a candelabra LED B-10 lamp with new multi-tier light distribution element optic and finned heatsink with internal driver

FIG. 25 illustrates a product application of the multiple-tier optical system. The candelabra lamp disclosed is comprised of the following: an electrical contact 2500, an isolator 2501, a heatsink 2502 with internally enclosed power electronics, 2503 LED light source, an omnidirectional multiple-tier light dispersion system 2504 similar to FIG. 18, a glass envelope, diffuser, or milky glass bulb shell 2505, which ultimately produces light distribution 2506. The advantage of integrating the optical element of FIG. 18 or the others into a lamp is to produce an omnidirectional distribution which closely emulates that of the omnidirectional distribution of a tent filament incandescent illustrated in FIG. 1. As can be clearly shown the optical device 2504 overcomes the problem of dispersing light downward around the cross-sectional obstruction of the heatsink. The LED light source 2503 used in combination with the optical device 2504 constitute the primary novelty as embodied herein as evidenced by the sparkle and pleasing light effect produced. A traditional Lambertian emitting LED would not produce any indirect light and would leave decorative elements of light fixture metals, finishes, paints, and ornaments in the dark or shadow.

Figure 26:
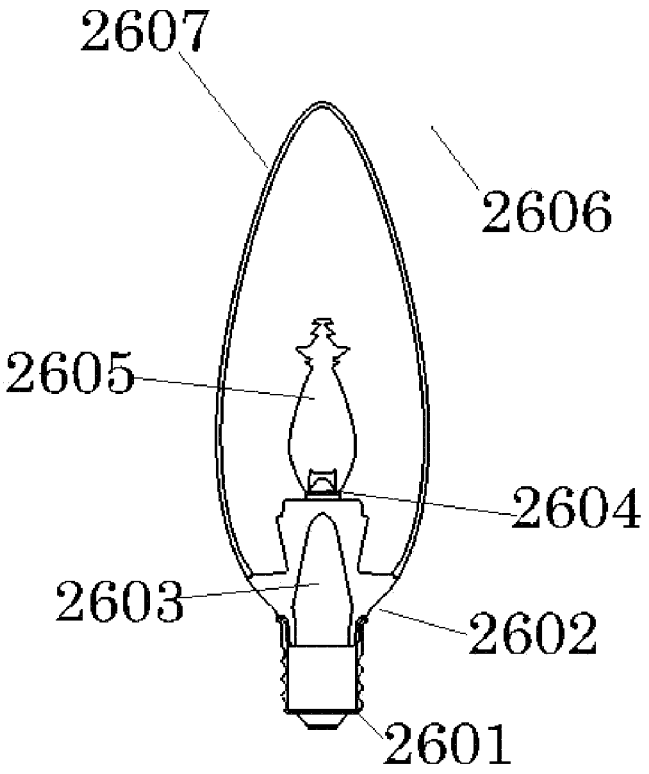
FIG. 26 illustrates a candelabra AC LED B-10 lamp with new multi-tier light distribution element optic.

FIG. 26 represents a B-10 lamp in which reduced heatsink area further enhances the appearance of the light source and allows for the greatest degrees of indirect light emission with minimal light occlusion. The lamp comprised of an electrical contact 2601, isolator base 2602, AC LED current control driver internally housed in the cavity 2603 or DC driven remotely in which an AC LED is not required. The AC LED 2604 includes many chips to allow for direct line AC power thereby reducing the size of the driver required. Multiple tier optical element 2605 throws light in all directions 2606, after passing through a clear glass or diffusive glass bulb protection element 2607.

Figure 27A:
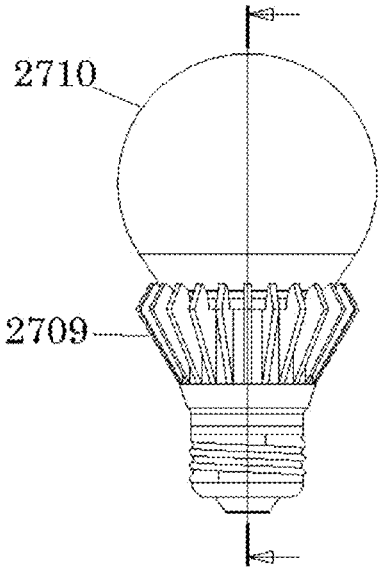
FIG. 27 illustrates an LED A-19 lamp with new multi-tier light distribution element optic, finned heatsink and internal driver.
Figure 27B:
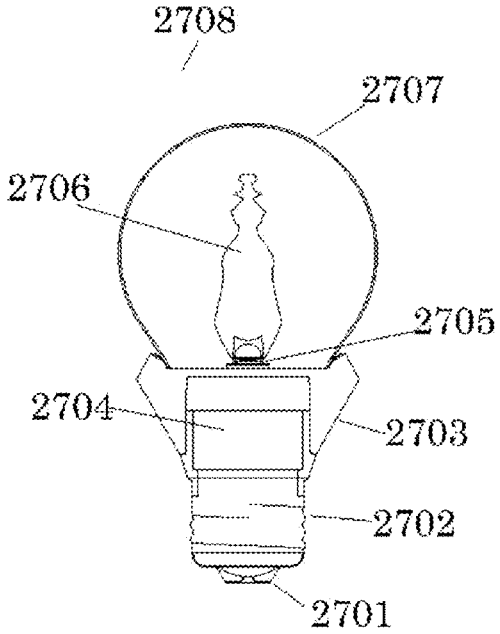

FIG. 27 represents an A-lamp in when the core light elements are comprised of a high efficiency light source 2705, and an omnidirectional lightguide optic incorporating multiple-tiers of light dispersion elements 2706 similar to the FIG. 21 system. The A-lamp shown has heatsink structure 2703 and 2709 which conducts, and radiates heat to the air to cool the LED array. The parts disclosed include an electrical contact 2701 an edison or GU24 base 2702 and may have either a clear bulb glass 2707 or a diffuse glass 2710 which produces a soft white appearance. The soft white bulb glass 2710 is produced by either milky white die infused glass or glass sputtered with fused silica micro-particles on the inside. The light distribution produced 2708 is a standard omnidirectional distribution required for energy star rebates.

Figure 28:
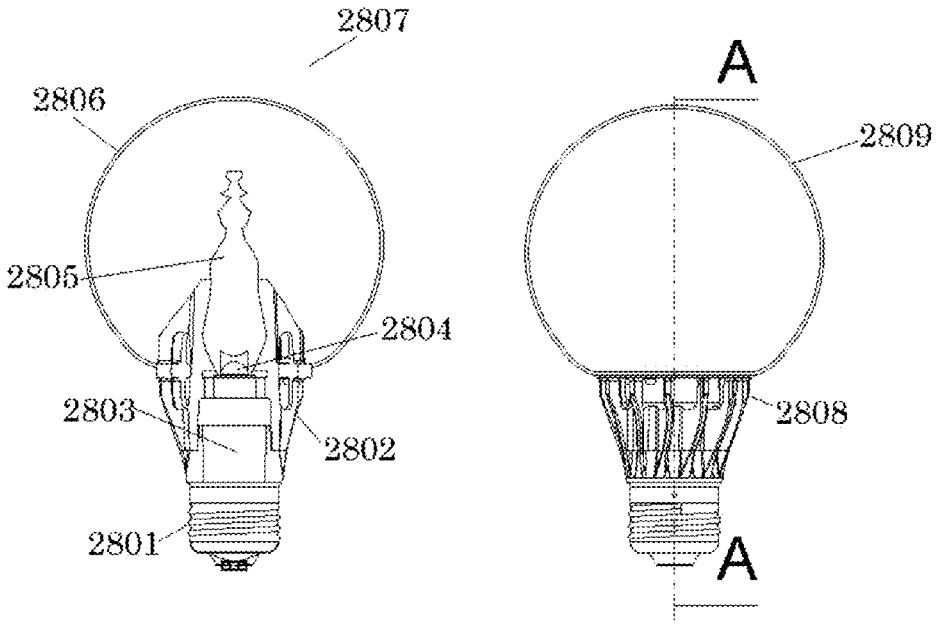
FIG. 28 illustrates an LED G-25 lamp including new multi-tier light dispersion optic, finned air-path heatsink and internal driver.

FIG. 28 is a globe light G25 used for vanity lights and mirrors. The major parts disclosed include a heatsink with both an upper and bottom part enabled by the multiple-tier optics disclosed. An additional benefit or application of the light-guiding optic serves to allow for heatsinks which surround the optical element without severely disrupting light distribution. The heatsink doubles the heat dissipation area and allows the lamp to produce more light greater than 1000 lumens, while keeping the solid-state light source cool. Solid-state light sources produce a large byproduct of heat which must be conducted away. The outer geometry of LED lamps balance the size of the heat sink with the size of the glass. Larger heat sinks with truncated globes like that of FIG. 9 have a high capacity to dissipate heat, large space to accomodate a driver, but poor light distribution. FIG. 26 shows a lamp with a desirable wide light distrubution, but poor heat disipation and small driver space. FIG. 28 strikes a balance between these extremes by extending a portion of the heat sink 2401 into the globe space. The increased surface area allows for thermal radiation and convection currents to transport heat within the globe. FIG. 28 illustrates how the optical element can guide light through the center of the heatsink thereby improving the aspect ratio of the heatsink for omnidirectional light distribution. The parts which constitute the LED globe light include screw base 2801, driver electronics enclosed in 2803, heatsink with both upper and lower parts 2802 and 2808, solid state light source 2804, novel omnidirectional multiple tier optic 2805, diffuse glass 2806 or clear glass 2809 and finally the light distribution field 2807.

Figure 29:
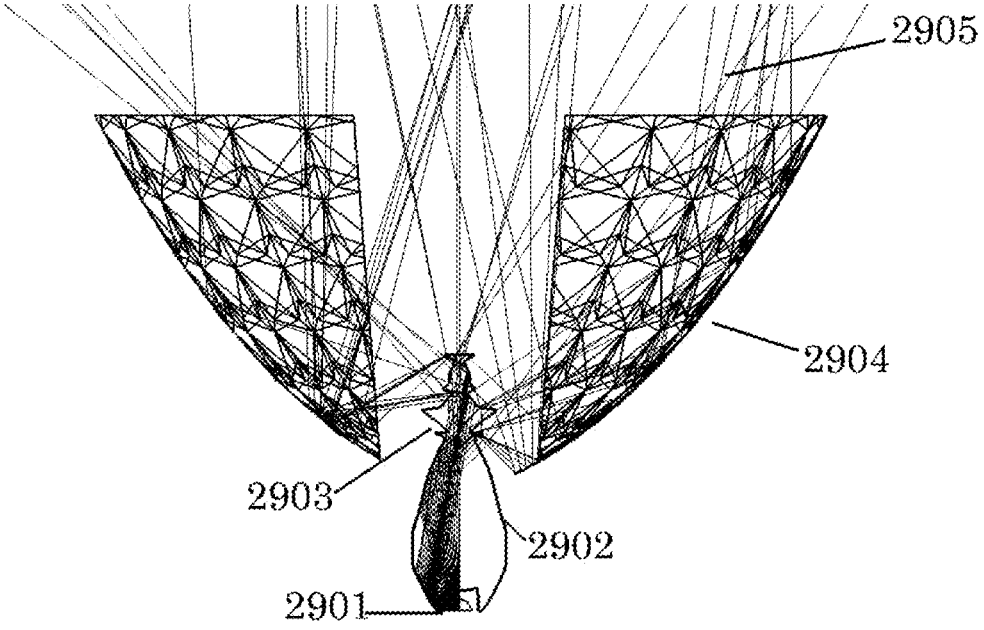
FIG. 29 illustrates an Asymmetric distribution PAR lamp utilizing new multi-tier dispersion element optic+faceted reflector.

FIG. 29 depicts an additional application of the disclosed multiple-tier optical device when used with a multi-faceted reflector. Light source 2901 illuminates optical device 2902 which produces either a butterfly or omnidirectional distribution 2903. The light reflects forward by means of the faceted spline reflector 2904 to produce an asymmetric beam 2905. Applications for the system disclosed include track lights for product highlight, retail showcase, produce sale, or museum display. The omnidirectional optic+reflector system may also be incorporated in a PAR light bulb.

Figure 30:
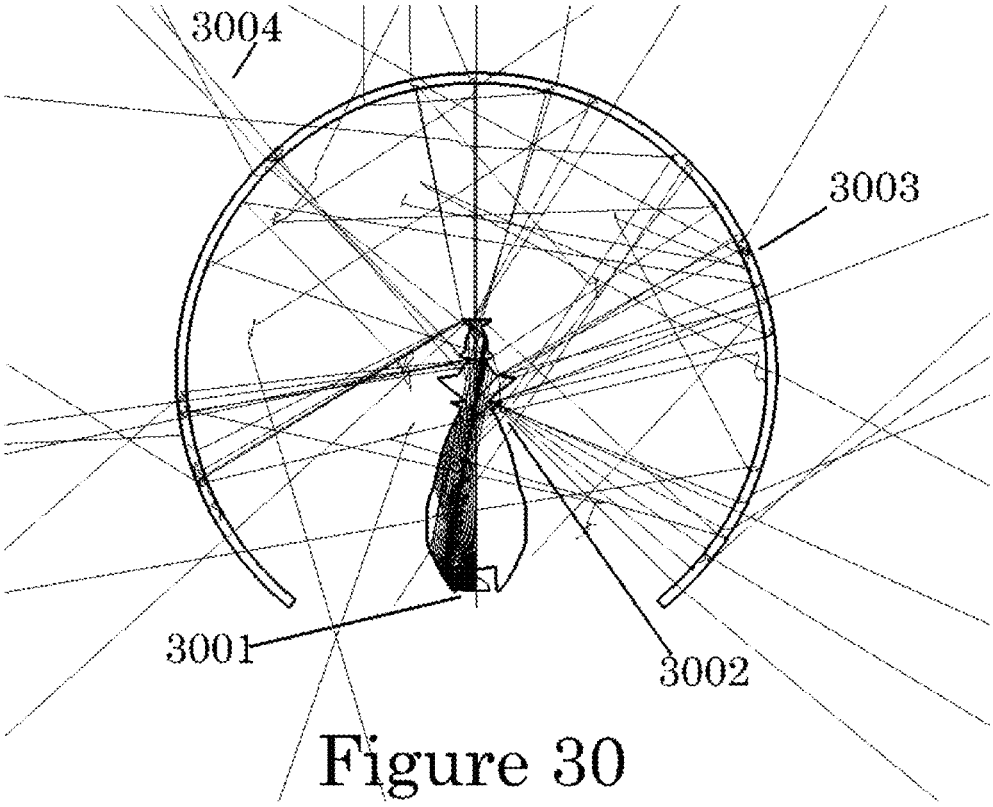
FIG. 30 illustrates a Remote luminescent shell pumped by means of cyan/blue/UV light emitting from a multiple-tier dispersion element optic

FIG. 30 represents an alternative application for the disclosed multiple-tier optical device 3002 when used with a primary pump source 3001 and remote wavelength conversion shell 3003. As shown the wavelength conversion from cyan, blue, or UV to white is performed remotely by a luminescent glass shell or polymer in which wavelength conversion lumiphors, phosphors, or quantum dot/phosphor composite fillers produce a pleasing white in color temperature ranging from 2500-7000K. The mean free path of the light as it traverses the luminescent shell enhances the intensity uniformity of the light. However, to produce uniform chromaticity in all intensity zones, the uniformity of pump light distribution produced via the novel optical device 3002 is critical and may require additional light control tiers to fill <1 degrees zones.

Figure 31:
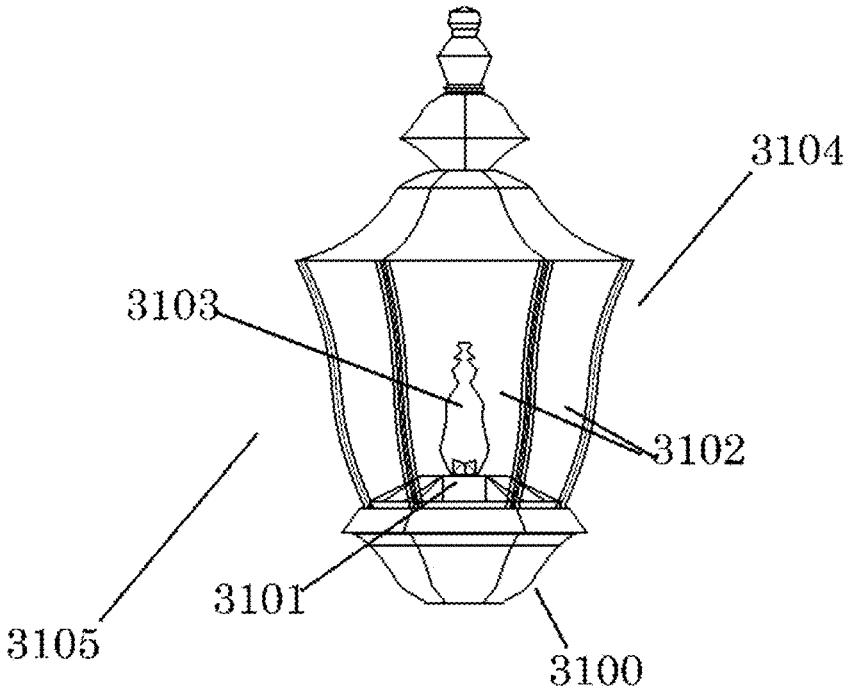
FIG. 31 illustrates a Street or park lantern sourced by means of a multi-tier light distribution element optic.
Figure 32:
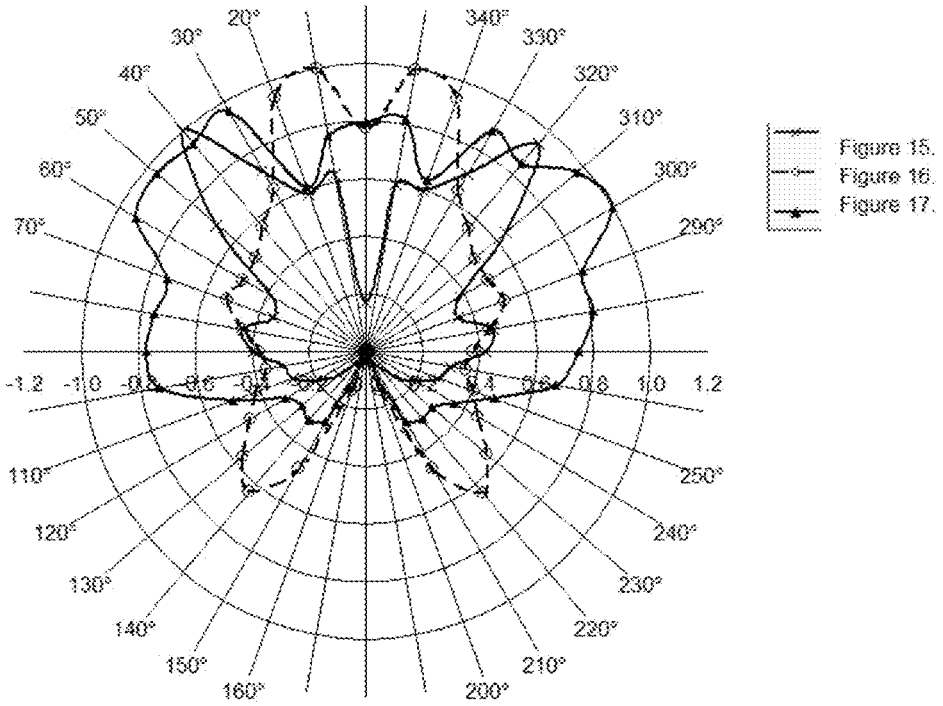
FIG. 32 illustrates an Intensity distribution based on FIGS. 15-17.

FIG. 31 depicts a post lantern 3100 for outdoor use which uses an omnidirectional optical device 3103 such as the embodiment shown in FIG. 21. The critical components comprising the lantern shown in FIG. 31 are the decorative heatsink base 3101, the LED light source, and the omnidirectional device 3103. Also shown are the glass cover plates 3102, through when the direct light distribution 3104, lateral, and indirect light distribution 3105 pass. FIG. 32 show the polar light distribution patterns produced by the omnidirectional optical devices disclosed in the embodiments FIG. 15-FIG. 17. A description of the light distributions enclosed in FIG. 32 follows. Graph label FIG. 15 produces a light distribution with strong lateral and upward light with a dip in the center directly upward. This emulates the ceramic metal halide T4 source. The distribution data of FIG. 16, shown in FIG. 32, produces strong direct and indirect light distribution with minimal lateral distribution of light.

Finally, FIG. 17 is a light distribution which produces light strongly in 3 major intensity zones both indirectly, laterally to the sides, and upward.

Figure 33:
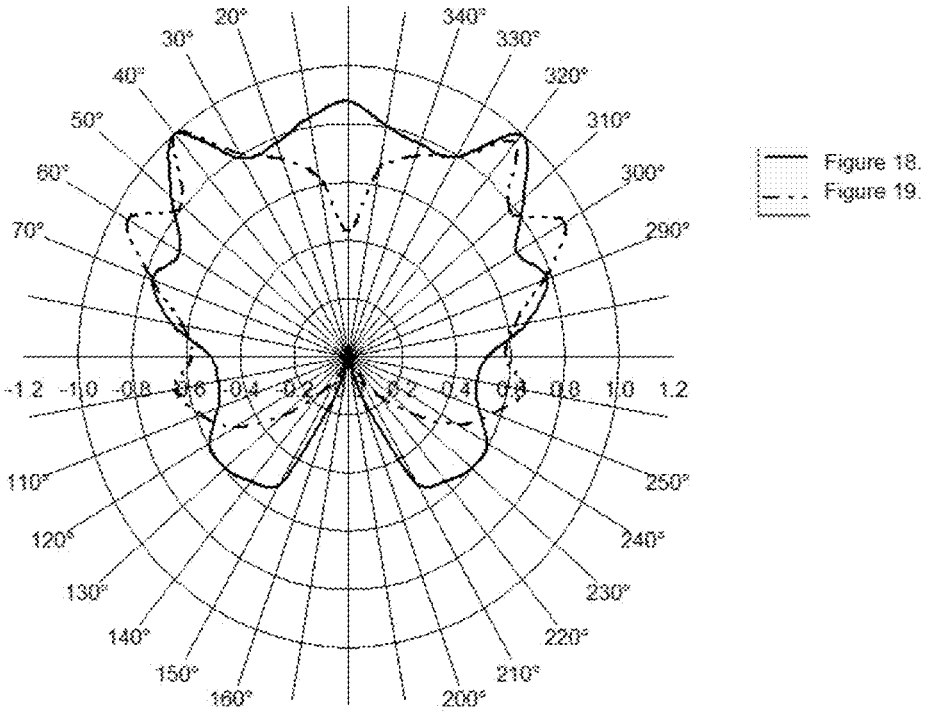
FIG. 33 illustrates an Intensity distribution based on FIGS. 18-19.

FIG. 33 shows two polar light intensity distributions produced by the geometry embodied in FIGS. 18 and 19. FIG. 18 omnidirectionally produces light with the emphasis placed on throwing light directly and to the upward sides with good indirect light as well. FIG. 19 data plot produces less light directly upward and downward in order to increase upward lateral light for decorative shades or ceiling light.

Figure 34:
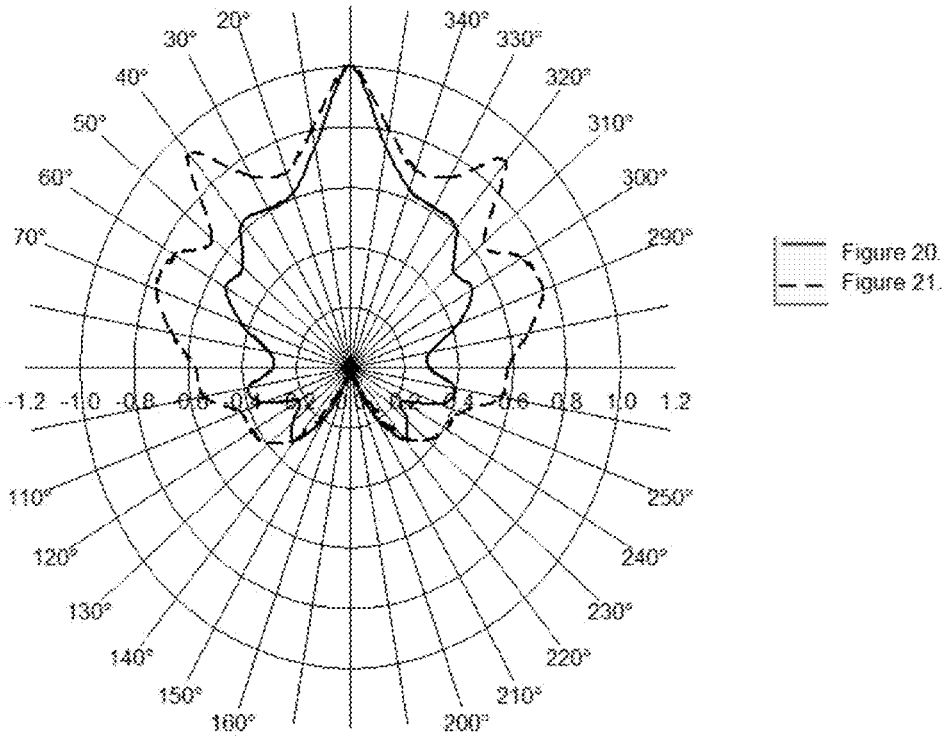
FIG. 34 illustrates an Intensity distribution based on FIGS. 20-21.
Figure 35:
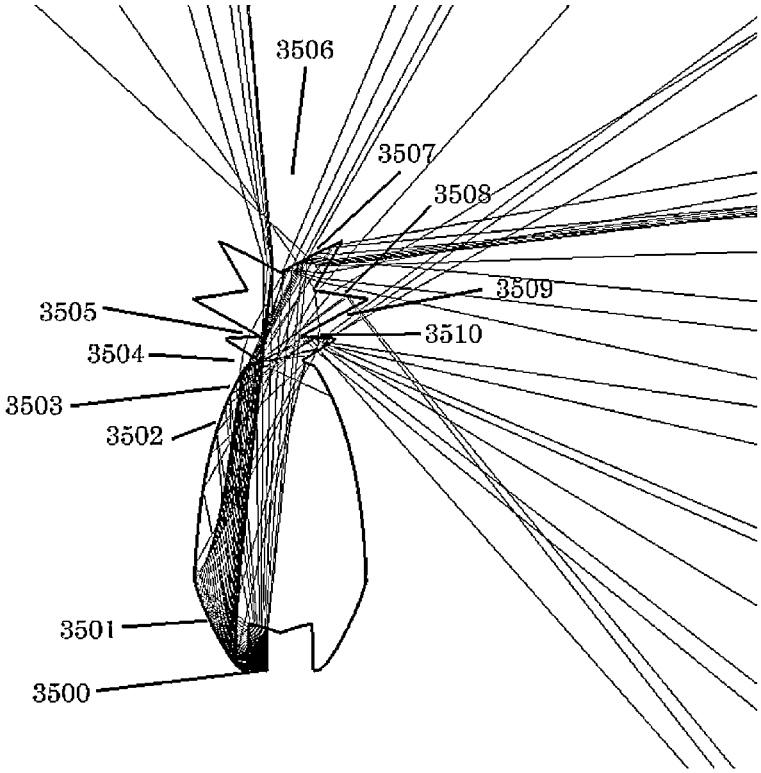
FIG. 35 illustrates an SLC with multiple-stage internal primary light guide and combination of both internal and externally fed multiple tiers of TIR/refractor light dispersion elements.

FIG. 34 has two light distributions comprised of FIGS. 20 and 21. FIG. 20 producing more direct light strengths than the omnidirectional light distribution of the FIG. 21 data plot. FIG. 35 shows the ray trace or optical ray path representation of a solid-state light source 3500 illuminating an optical device which is comprised of a dielectric TIR optical control surface 3501 which directs and concentrates light to secondary TIR light guide surface 3502. Secondary concentration occurs near the zone 3503, after which a portion of the light is allowed to exit at 3504. Light emanating after control surface 3504 fills indirect intensity zones and additional light traverses through air before re-entering the optical device shown at zone 3505.

The end result is an omnidirectional field of light 3506 as a result of catadioptric control surfaces 3507, 3508, 3509, and 3510. Further defining "catadioptric" in this embodiment refers to a combination of TIR mirror optical operation and refractive operation. A catadioptric surface allows light to refract forward, to TIR downward or laterally internal to the dielectric, before final refractive optical control produced by an exit optical surface. The multiple tiers of catadioptric elements behave in such a manner to throw light into a spherical or omnidirectional distribution.

Figure 36:
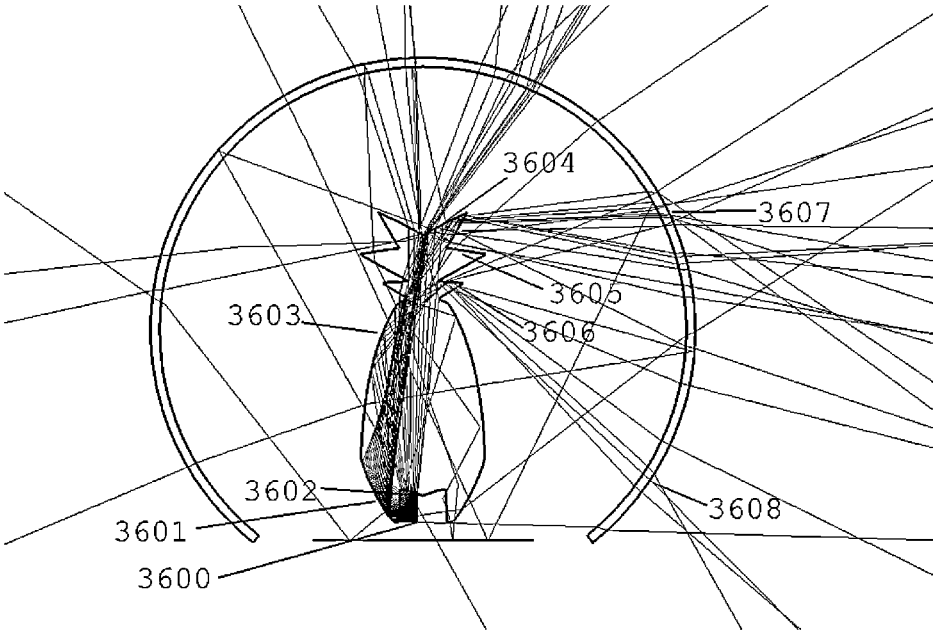
FIG. 36 illustrates the omnidirectional optic of FIG. 35 plus glass globe diffuser with internal coating of dielectric diffusion dust.

FIG. 36 shows a light source 3600 which produces light which is partially captured and concentrated by TIR surface 3601 and refractive surface 3602. The light begins to undergo further concentration and redirection by means of light guiding surface 3603. Primary optical operators to produce omnidirectional light include the tree or tiers of combination TIR, refractive elements which behave in a manner characteristic of a TIR mirror+refractor in which the TIR mirror is not 100% reflective but may allow split portion of reflection by means of total internal reflection allowing the residual of the light to continue forward into the air, in other words some light is allowed to frustrate TIR and pass forward or upward. Refractor element 3605 controls light before feeding the tier element 3604. Tier element 3604 direct light downward, refracts light before passing into the air and control light which does not TIR back reflect into succeeding tiers further forward and upward in the construction of the optic. The glass or polymer cover 3607 may include a fine particle <50 um, dielectric dust on the inside or outside surface to further randomize the light paths and produce a more uniform distribution as shown by 3608.

Figure 37:
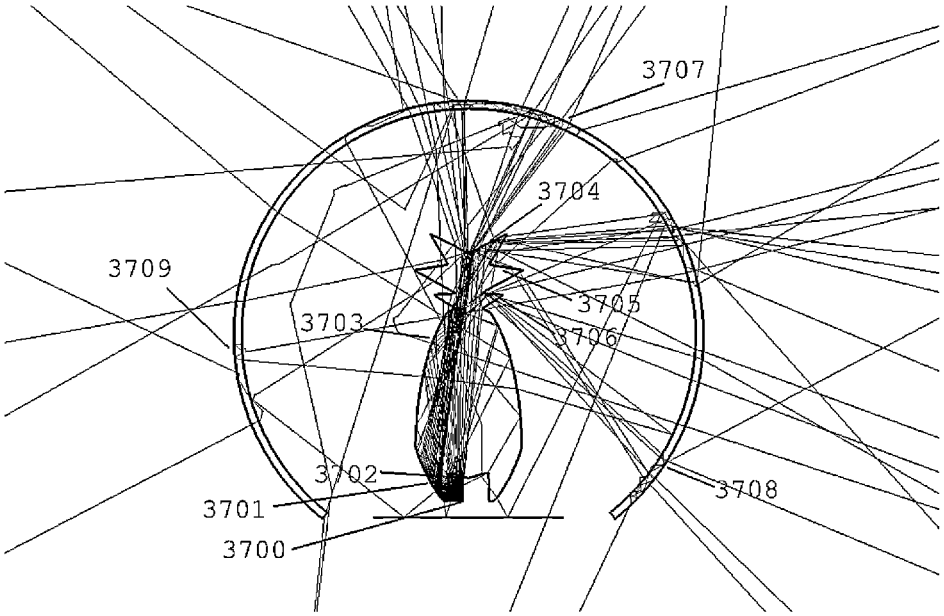
FIG. 37 illustrates the omnidirectional optic of FIG. 35 plus glass globe diffuser with internal coating of dielectric diffusion dust plus+volumetric diffuser material imbedded in the glass or polymer.

FIG. 37 illustrates a solid-state light source 3700 which produces light which is concentrated by primary TIR surface 3701, and refractive surface 3702, before further concentration by light guiding section 3703. The optical tier element 3704 functions as a TIR mirror/refractor element to both control light passing upward, to split light and TIR mirror the light laterally or downward internal to the element, and to control light through refraction before allowing to pass into the air. Additional optical tier elements 3705 and 3706 also fill additional indirect, and lateral intensity zones to produce the net effect of an omnidirectional light distribution. Protective glass or polymer part 3708 includes volumetric or internal dielectric materials imbedded in the glass or polymer of a different refractive index higher or lower than the host glass or polymer refractive index for the purpose of diffusing or randomizing the direction cosines of the light incident from the inside. As shown by the curling or internal wave guiding and redirection of the ray paths in 3709 the net effect is a higher uniformity distribution of light.

Figure 38:
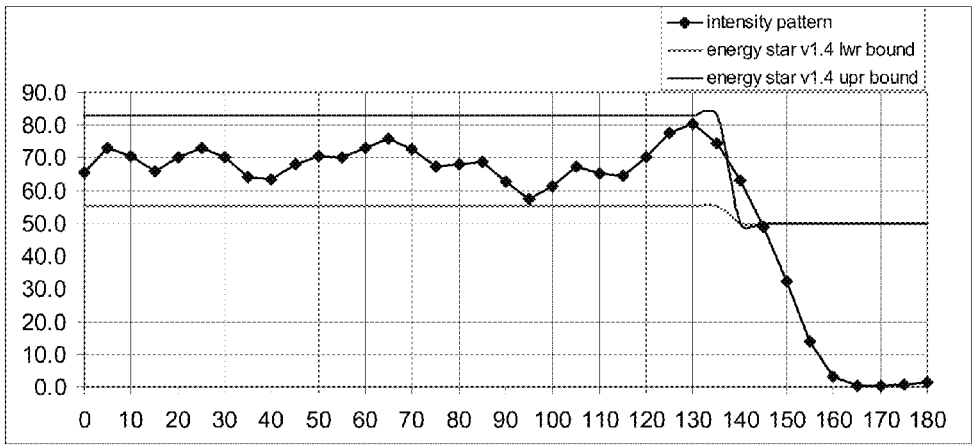
FIG. 38 illustrates the omnidirectional intensity distribution of the optic depicted in FIG. 36.

FIG. 38 depicts the omnidirectional intensity distribution of the optic depicted in FIG. 36 in which the intensity distribution spans from 0 or directly above the light source to 180 deg or below and downward. Included is the specification for energy efficiency or energy star which requires a light uniformity with a maximum deviation from average of 20%. Also required is sufficient indirect light from the 135 deg zone to 180 to constitute >5% of the total light output of the lamp. As shown the optical device meets the specification with 2-4% additional margin.

Figure 39:
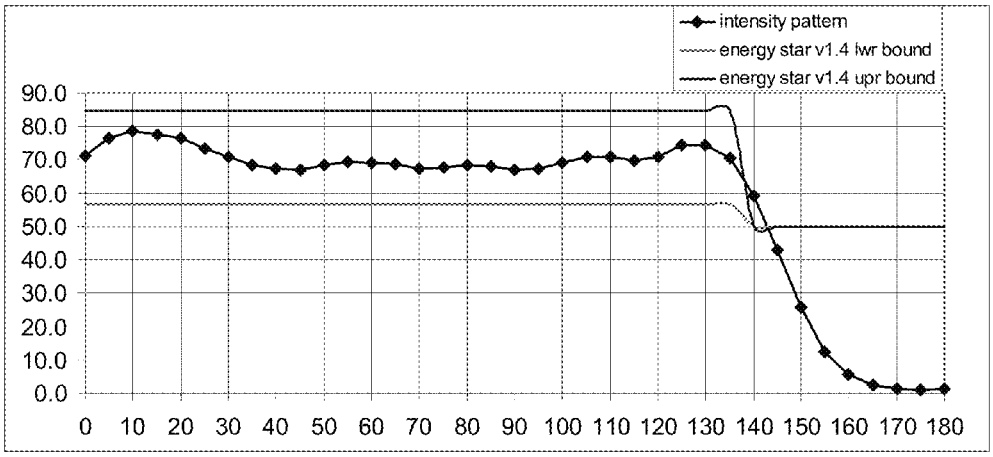
FIG. 39 illustrates the omnidirectional intensity distribution of the optic depicted in FIG. 37 with additional uniformity.

FIG. 39 depicts the omnidirectional intensity distribution of the optic depicted in FIG. 37 in which the intensity distribution spans from 0 or directly above the light source to 180 deg or below and downward. Included is the specification for energy efficiency or energy star which requires a light uniformity with a maximum deviation from average of 20%. Also required is sufficient indirect light from the 135 deg zone to 180 to constitute >5% of the total light output of the lamp. As shown the optical device meets the specification with 8-18% additional margin, which constitutes close to 90% intensity uniformity as required for clean, striation-free omnidirectional illumination.

Figure 40:
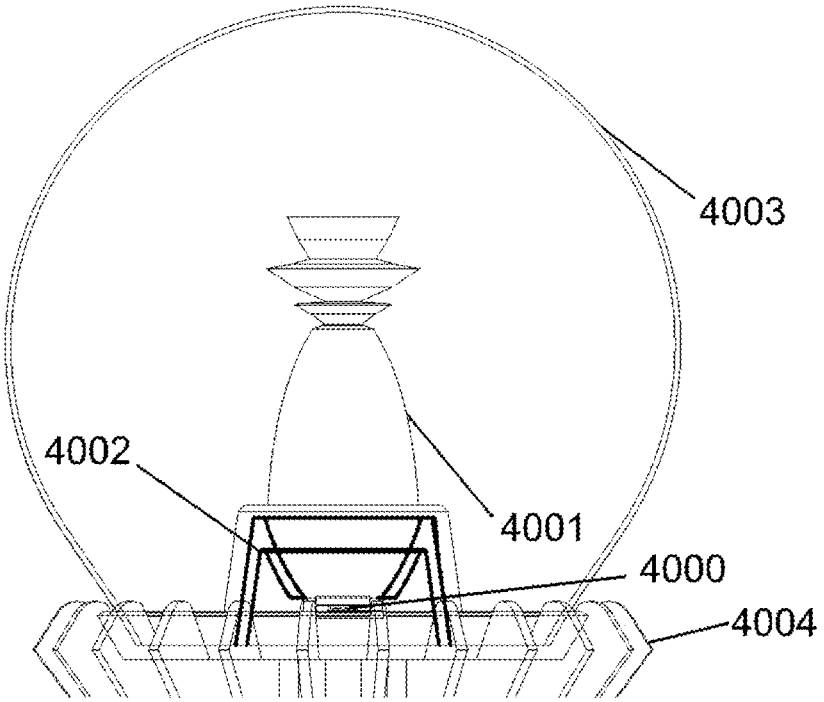
FIG. 40 illustrates the omnidirectional optic of FIG. 35, 36 or 37 combined with a recycler part.

FIG. 40 shows the light source 4000 emitting light through the optical device 4001 of FIG. 35 with an additional recycler part 4002 comprised of a high reflectance metallic coating, or high reflectance white material to recycle residual light not captured by the imperfect TIR primary surface. The best TIR surfaces may have 4-20 nm surface roughness or Ra, which produces some leakage of light. Additionally some light is Fresnel reflected by internal air/dielectric walls between the light source and the optic. The recycler part improves light transfer efficiency by 3-4%. Also shown is the protective glass or polymer shell 4003 which may include diffusion properties on the internal coating or imbedded within the host material. Part 4004 shows the finned heatsink used to dissipate heat produced by light source 4000.

Figure 41:
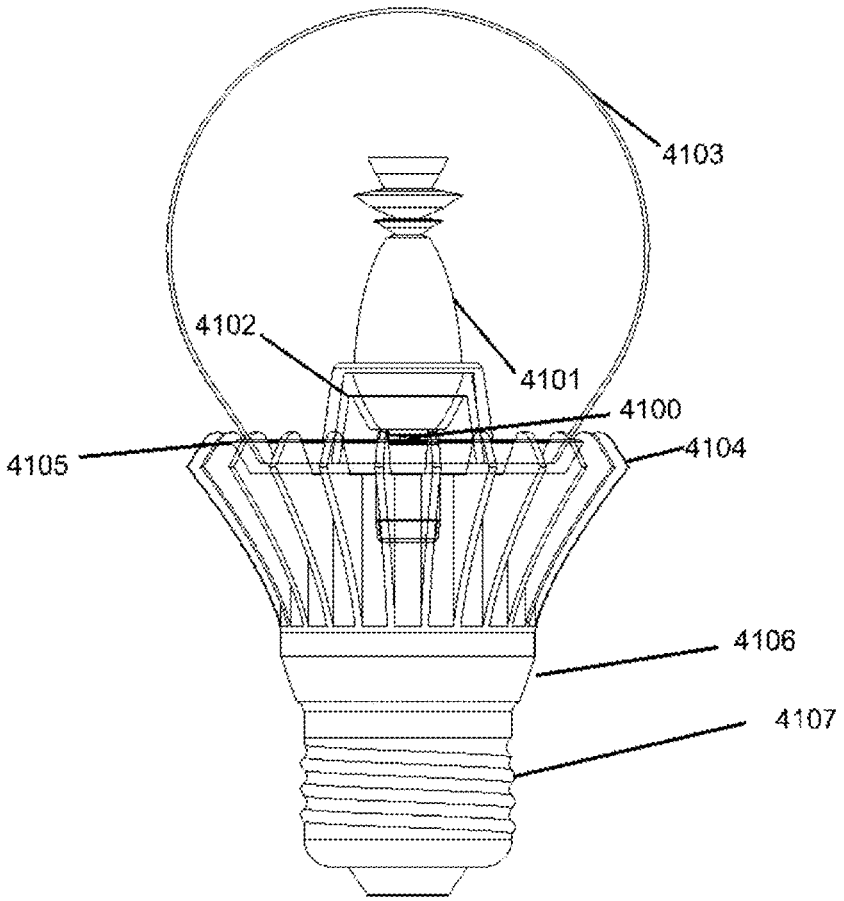
FIG. 41 illustrates the complete lamp including the multiple tier omnidirectional optic, recycler, heatsink, glass protective part.

FIG. 41 shows a complete next generation lamp including a high efficiency light source 4100 which preferably produces warm white light at >150 lumens/Watt, as redirected and distributed by optical device 4101, recycler 4102, diffuser glass/polymer part 4103, held in place by transparent holder 4105, and heat sink part 4104. 4106 constitutes an electrical isolator part comprised of glass-filled polymer, or ceramic, and an electric contact 4107, which may be an Edison base, bayonet, or GU10, or GU24 base. The lamp produces light in an omnidirectional distribution for the purpose of general illumination with higher sustainability than an incandescent heater filament due to the luminous efficacy achieved.

Furthermore, other areas of art may benefit from this method and adjustments to the design are anticipated. Thus, the scope of the invention should be determined by the appended claims and their legal equivalents, rather than by the examples given.

I claim:

1. A multiple-tier omnidirectional solid-state emission source comprising:

a dielectric TIR optical control surface which directs and concentrates light to a secondary TIR lightguide surface;

a secondary concentration occurs near a first zone after which a portion of the light is allowed to exit;

light emanating after control surface fills indirect intensity zones and additional light traverses through air before re-entering the optical device in a second zone; and the end result is an omnidirectional field of light as a result of catadioptric control of a plurality of surfaces.

2. The multiple-tier omnidirectional solid-state emission source of claim 1, further comprising a combination of TIR mirror optical operation and refractive operation;

a catadioptric surface allowing light to refract forward, to the TIR downward or laterally internal to the dielectric, before final refractive optical control produced by an exit optical surface; and the multiple tiers of catadioptric elements behave in such a manner to throw light into a spherical or omnidirectional distribution.

3. The multiple-tier omnidirectional solid-state emission source of claim 1, producing omnidirectional light distribution by means of a dielectric light guide and multiple tiers of catadioptric control surfaces.

4. The multiple-tier omnidirectional solid-state emission source of claim 3, further comprising:

an additional reflective element is positioned at the base of the primary light guide to recycle light normally lost through imperfections in TIR mirror surfaces thereby improving efficiency of light transfer and overall efficacy of the lighting source.

5. The multiple-tier omnidirectional solid-state emission source of claim 3, further comprising:

a heat sink with fins;

an isolator base; and an electrical contact.

6. The multiple-tier omnidirectional solid-state emission source of claim 3, in which a primary light guide feeds a secondary light guide which in turn redistributes light into an omnidirectional light distribution by means of a tree of catadioptric control elements.

7. The multiple-tier omnidirectional solid-state emission source of claim 6, further comprising:

an additional reflective element is positioned at the base of the primary light guide to recycle light normally lost through imperfections in TIR mirror surfaces thereby improving efficiency of light transfer and overall efficacy of the lighting source.

8. The multiple-tier omnidirectional solid-state emission source of claim 5, in which light emanating from a solid state light source such as an LED or light emitting diode is converted from a lambertian distribution to an omnidirectional distribution by means of a two stage light guide and multiple tiers of catadioptric elements.

9. The multiple-tier omnidirectional solid-state emission source of claim 8, further comprising:

an additional reflective element is positioned at the base of the primary light guide to recycle light normally lost through imperfections in TIR mirror surfaces thereby improving efficiency of light transfer and overall efficacy of the lighting source.

10. The multiple-tier omnidirectional solid-state emission source of claim 1, wherein light emanating from a solid state light source such as an LED or light emitting diode is converted from a lambertian distribution to a butterfly distribution meaning a distribution of light comprised of primarily lateral light intensity with less light in the direct and indirect zones by means of a two stage light guide and multiple tiers of catadioptric elements.

11. The multiple-tier omnidirectional solid-state emission source of claim 10, further comprising:

an additional reflective element is positioned at the base of the primary light guide to recycle light normally lost through imperfections in TIR mirror surfaces thereby improving efficiency of light transfer and overall efficacy of the lighting source.

12. The multiple-tier omnidirectional solid-state emission source of claim 1, wherein light emanating from a solid state light source such as an LED or light emitting diode is converted from a lambertian distribution into a purely indirect distribution meaning a distribution of light comprised of primarily downward light intensity with less light in the direct and lateral intensity zones by means of a two stage light guide and multiple tiers of catadioptric elements.

13. The multiple-tier omnidirectional solid-state emission source of claim 12, further comprising:

an additional reflective element is positioned at the base of the primary light guide to recycle light normally lost through imperfections in TIR mirror surfaces thereby improving efficiency of light transfer and overall efficacy of the lighting source.

14. The multiple-tier omnidirectional solid-state emission source of claim 1, wherein light emanating from a solid state light source such as an LED or light emitting diode is converted from a lambertian distribution into a purely indirect distribution meaning a distribution of light comprised of primarily downward light intensity with less light in the direct and lateral intensity zones by means of a two stage light guide and multiple tiers of catadioptric elements.

15. The multiple-tier omnidirectional solid-state emission source of claim 8, wherein light emanating from a two stage light guide and multiple tiers of catadioptric elements is further diffused by means of a free-form glass or polymer shell which has been modified by micro-surface textures, fused silica powder coatings, silicone diffusion patterns painted on the inside or outer surface, or by means of surface roughness.

16. The multiple-tier omnidirectional solid-state emission source of claim 8, wherein light emanating from an optical device comprised of a two stage light guide and multiple tiers of catadioptric elements is further diffused to increase homogeneity by means of a free-form volumetric scatterer imbedded in a glass or polymer shell outside of said optical device.

* * * * *